US012791238B2

(12) United States Patent
Ishigaki et al.

(10) Patent No.: US 12,791,238 B2
(45) Date of Patent: Nov. 10, 2026

(54) REFRIGERANT AMOUNT DETERMINATION SYSTEM

(71) Applicant: Mitsubishi Electric Corporation, Tokyo (JP)

(72) Inventors: Mitsuhiro Ishigaki, Tokyo (JP); Masahiro Ito, Tokyo (JP); Daisuke Shimamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 365 days.

(21) Appl. No.: 18/704,188

(22) PCT Filed: Dec. 23, 2021

(86) PCT No.: PCT/JP2021/048059
§ 371 (c)(1),
(2) Date: Apr. 24, 2024

(87) PCT Pub. No.: WO2023/119605
PCT Pub. Date: Jun. 29, 2023

(65) Prior Publication Data

US 2025/0216133 A1 Jul. 3, 2025

(51) Int. Cl.
*F25B 49/00* (2006.01)

(52) U.S. Cl.
CPC ..... *F25B 49/005* (2013.01); *F25B 2500/19* (2013.01); *F25B 2600/05* (2013.01)

(58) Field of Classification Search
CPC .. F25B 13/00; F25B 2500/19; F25B 2600/05; F25B 2700/21163; F25B 49/005; F25B 49/02
See application file for complete search history.

(56) References Cited

U.S. PATENT DOCUMENTS

2009/0126375 A1 5/2009 Toyoshima et al.
2009/0151374 A1 6/2009 Kasahara
(Continued)

FOREIGN PATENT DOCUMENTS

EP 1970651 A1 9/2008
GB 2553972 A 3/2018
(Continued)

OTHER PUBLICATIONS

International Search Report of the International Searching Authority mailed Feb. 1, 2022 in corresponding International Application No. PCT/JP2021/048058 (and English Machine Translation).
(Continued)

*Primary Examiner* — Thien M Le
(74) *Attorney, Agent, or Firm* — Posz Law Group, PLC

(57) ABSTRACT

A construction worker installs a refrigeration cycle apparatus and fills the refrigeration cycle apparatus with a refrigerant. When the refrigeration cycle apparatus is filled with the refrigerant and consent of a customer is obtained, a maintenance worker transmits a start command from a terminal device to a cloud server. After receiving the start command, the cloud server transmits control data to the refrigeration cycle apparatus and performs control in a refrigerant amount detection mode. The cloud server receives operation data from the refrigeration cycle apparatus, calculates a refrigerant amount in the refrigeration cycle apparatus, using the operation data, determines from the refrigerant amount, whether the refrigerant amount is excessive or insufficient, and transmits a determination result to the terminal device and the terminal device.

6 Claims, 21 Drawing Sheets

(56) References Cited

U.S. PATENT DOCUMENTS

| | | | | |
|---|---|---|---|---|
| 2010/0154447 | A1 | 6/2010 | Yoshimi et al. | |
| 2011/0036104 | A1 | 2/2011 | Toyoshima et al. | |
| 2011/0308267 | A1* | 12/2011 | Tamaki | F25B 49/005 62/430 |
| 2013/0318011 | A1* | 11/2013 | Jones | G05B 23/0243 706/12 |
| 2016/0067942 | A1* | 3/2016 | Pawlak | B32B 27/40 428/159 |
| 2016/0146488 | A1 | 5/2016 | Ochiai et al. | |
| 2018/0128529 | A1* | 5/2018 | Chen | F25B 45/00 |
| 2018/0283724 | A1* | 10/2018 | Van Eldik | F25B 49/022 |
| 2019/0390885 | A1* | 12/2019 | Contrada | F25B 49/022 |
| 2020/0300522 | A1* | 9/2020 | Inao | F25B 49/005 |
| 2022/0235975 | A1* | 7/2022 | Ohura | G06F 30/18 |
| 2023/0235933 | A1* | 7/2023 | Sasaki | F24F 11/49 62/129 |
| 2024/0035695 | A1* | 2/2024 | Mohammad | F24F 11/36 |
| 2024/0175595 | A1* | 5/2024 | Sasaki | F24F 11/63 |
| 2024/0353260 | A1* | 10/2024 | Lewis | G01J 3/463 |
| 2025/0216134 | A1 | 7/2025 | Ito et al. | |

FOREIGN PATENT DOCUMENTS

| | | | |
|---|---|---|---|
| GB | 2563508 | A | 12/2018 |
| JP | 2007-163101 | A | 6/2007 |
| JP | 2007-163103 | A | 6/2007 |
| JP | 2007-198680 | A | 8/2007 |
| JP | 2007-255737 | A | 10/2007 |
| JP | 2008-025935 | A | 2/2008 |
| JP | 2008-164250 | A | 7/2008 |
| JP | 2008-190864 | A | 8/2008 |
| JP | 2009-079842 | A | 4/2009 |
| JP | 2010-002109 | A | 1/2010 |
| JP | 2010-236714 | A | 10/2010 |
| JP | 2011-012958 | A | 1/2011 |
| JP | 2012-117735 | A | 6/2012 |
| JP | 4957243 | B | 6/2012 |
| JP | 5063346 | B | 10/2012 |
| JP | 6403887 | B | 10/2018 |
| JP | 2019-066164 | A | 4/2019 |
| WO | 2007/049372 | A1 | 5/2007 |
| WO | 2015/004747 | A1 | 1/2015 |
| WO | 2017/163294 | A1 | 9/2017 |

OTHER PUBLICATIONS

International Search Report of the International Searching Authority mailed Feb. 1, 2022 in corresponding International Application No. PCT/JP2021/048059 (and English Machine Translation).

* cited by examiner

Fig. 15

| No. | | DETECTION VALUE | DETECTION SUBJECT | SUBJECT TO BE USED (REPRESENTATIVE SUBJECT) |
|---|---|---|---|---|
| 1 | HS | HS [1] | DISCHARGE PRESSURE | $T_c$, SC, $dT_c$, $C'_{pL}$, $\Delta h_{Lcon}$, $SH_d$, $C'_{pg}$ |
| 2 | LS | LS [2] | SUCTION PRESSURE | (FORMULA 6) |
| 3 | TH2 | TH2 [3] | OUTLET TEMPERATURE OF HIC 3 ON COMPRESSOR SIDE | Hb |
| 4 | TH3 | TH3 [4] | OUTLET TEMPERATURE OF OUTDOOR HEAT EXCHANGER 2 | SC, $\Delta h_{Lcon}$ |
| 5 | TH4 | TH4 [5] | DISCHARGE TEMPERATURE OF COMPRESSOR | $\Delta h_{Lcon}$, $SH_d$ |
| 6 | TH5 | TH5 [6] | INFLOW TEMPERATURE OF COMPRESSOR | $[dT_{c\ corr}]$, $G_{r_ratio}$ |
| 7 | TH7 | TH7 [7] | OUTDOOR TEMPERATURE | $dT_c$, $C'_{pL}$, $C'_{pg}$ |
| 8 | Sf | Sf [8] | FREQUENCY OF COMPRESSOR | $G_{r_ratio}$ |
| 9 | S4 | S4 [9] | OPENING OF HIC-LEV 4 | $C_{v_HICLEV}$ |
| 10 | S6 | S6 [10] | OPENING OF LEV 6 | $C_{v_LEV}$, |

REFRIGERANT AMOUNT DETERMINATION SYSTEM

CROSS-REFERENCE TO RELATED APPLICATION

This application is a U.S. National Stage Application of International Application No. PCT/JP2021/048059 filed on Dec. 23, 2021, the contents of which are incorporated herein by reference.

TECHNICAL FIELD

The present disclosure relates to a refrigerant amount determination system to determine a refrigerant amount in a refrigerant circuit.

BACKGROUND

Conventional techniques include a technique to detect a refrigerant leakage amount in a refrigerant circuit (for example, Patent Literature 1). In the conventional techniques, a subcooling degree SC of a refrigerant at an outlet of a condenser needs to be greater than 0° C. If a condition is imposed that the subcooling degree SC is greater than 0° C. when the refrigerant leakage amount is detected, it is possible to detect a leakage of 10% or more, for example. However, it is not possible to quantitatively detect whether the leakage amount of the refrigerant is 20% or 30%. Therefore, since a refrigerant amount to be added is not known, an operator needs to collect all of the refrigerant from the refrigerant circuit, and fill the refrigerant circuit with a standard refrigerant amount written in a catalog. Accordingly, there is a problem that a maintenance work is burdensome.

Further, it is important for stable operation of a refrigeration cycle apparatus to enclose the refrigerant circuit with an appropriate refrigerant amount. When constructing the refrigeration cycle apparatus, a maintenance company or a sales agent of the refrigeration cycle apparatus performs test operation of the refrigeration cycle apparatus, and confirms whether or not the refrigerant enclosing amount is appropriate. This confirmation requires a skill based on experience of a maintenance worker, and it is difficult for an inexperienced maintenance worker to determine whether or not the refrigerant enclosing amount is appropriate. The same applies to determination of the refrigerant amount during normal operation of the refrigeration cycle apparatus, and to, using the determination, leakage determination of the refrigerant amount.

Conventionally, there has been no technique to calculate the refrigerant filling amount on the side of a refrigerant amount detection system according to terminal operation of the maintenance worker regardless of the human experience. Regarding this point, although Patent Literature 1 discloses refrigerant amount detection, there is no disclosure of the technique to calculate the refrigerant filling amount on the side of the refrigerant amount detection system according to the terminal operation of the maintenance worker regardless of the human experience.

PATENT LITERATURE

Patent Literature 1: JP 5063346 B2

SUMMARY

The present disclosure aims to provide a technique to calculate a refrigerant filling amount on the side of a refrigerant amount determination system according to terminal operation of a maintenance worker regardless of human experience.

A refrigerant amount determination system according to the present disclosure includes:

a server device;

a terminal device that communicates with the server device; and a refrigeration cycle side control device disposed in a refrigeration cycle apparatus including a compressor, a condenser, an expansion valve, and an evaporator, and having a refrigerant circuit in which a refrigerant circulates, wherein the terminal device transmits to the server device, a request signal that requests detection of a refrigerant amount present in the refrigerant circuit, and the server device, when receiving the request signal, performs to the refrigerant circuit via the refrigeration cycle side control device, control of a refrigerant amount detection mode which is an operation mode of the refrigeration cycle apparatus for detecting the refrigerant amount present in the refrigerant circuit, receives from the refrigeration cycle side control device, detection values of a plurality of sensors disposed in the refrigerant circuit, as a result of the control of the refrigerant amount detection mode, calculates the refrigerant amount present in the refrigerant circuit, using the received detection values of the plurality of sensors, determines whether the refrigerant amount present in the refrigerant circuit is excessive or insufficient, using the calculated refrigerant amount and a standard refrigerant amount held as a standard, and transmits to the terminal device, a determination result of the excess or insufficiency.

According to a refrigerant amount determination system of the present disclosure, it is possible to provide a technique to calculate a refrigerant filling amount on the side of a refrigerant amount determination system according to terminal operation of a maintenance worker regardless of human experience.

BRIEF DESCRIPTION OF DRAWINGS

FIG. 15 is a diagram of Embodiment 2 and is a diagram illustrating a detection value of each of sensors transmitted from the air conditioning side control device 400 to the cloud server 100CS.

DETAILED DESCRIPTION

Figure 1:
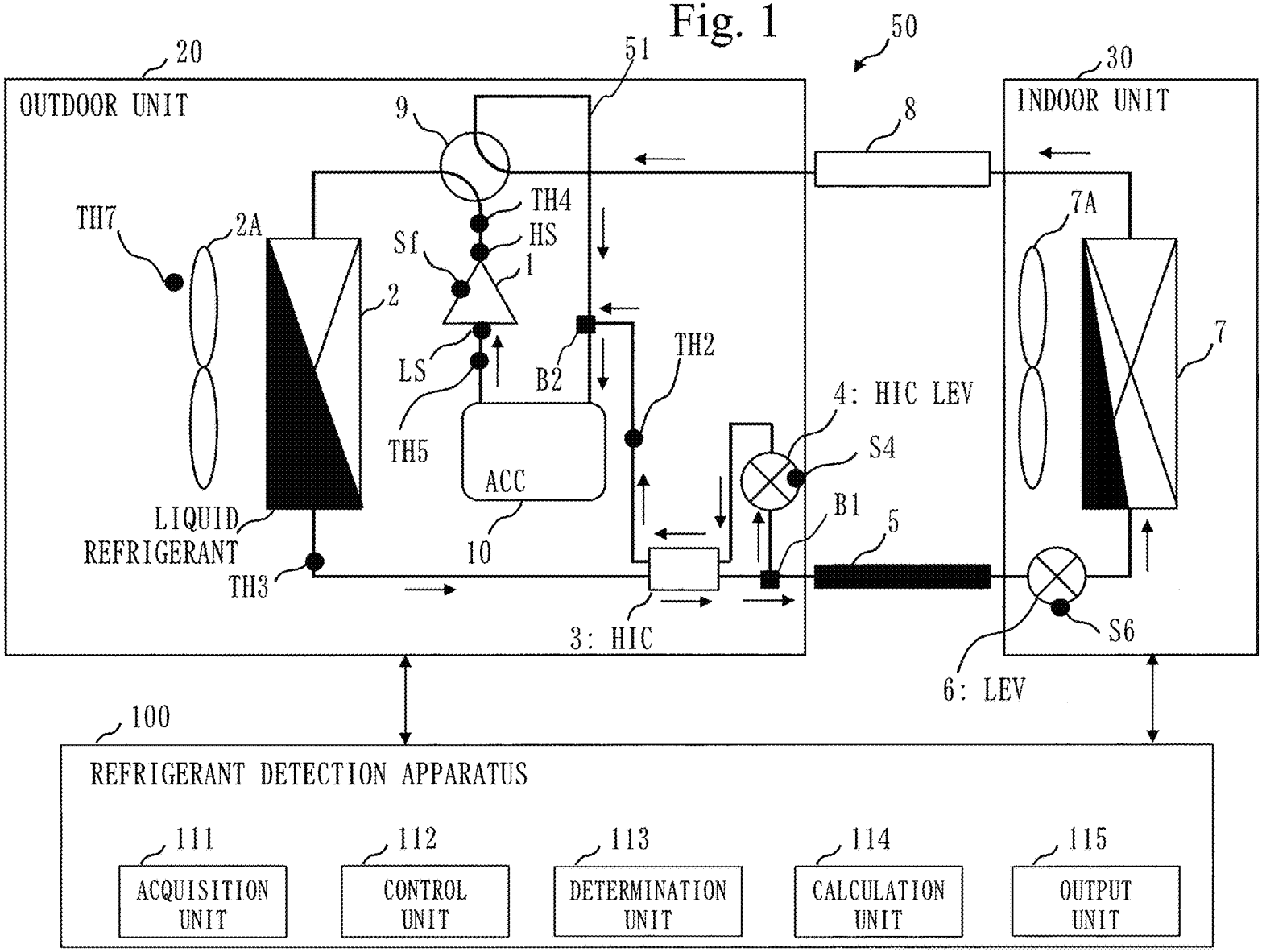
FIG. 1 is a diagram of Embodiment 1 and is a diagram illustrating a refrigeration cycle apparatus 50.

In the description and drawings of embodiments, the same elements and corresponding elements are denoted by the same reference sign. Description of an element denoted by the same reference sign will be appropriately omitted or simplified. In the following embodiments, "unit" may be appropriately replaced by "circuit", "stage", "procedure", "process", or "circuitry".

In FIGS. 1, 3, 4, and 5 to be described below, a liquid refrigerant is illustrated in black in an outdoor heat exchanger 2, a liquid pipe 5, an indoor heat exchanger 7, and an accumulator 10.

In the following embodiments, a value detected by a sensor is referred to as a detection value. A value that is set in a refrigerant detection apparatus 100 based on a specification of the apparatus rather than the detection value is referred to as a set value. The set value may also be referred to as a specification value.

Embodiment 1

The refrigerant detection apparatus 100 of Embodiment 1 will be described with reference to FIGS. 1 to 10.

FIG. 1 illustrates a refrigeration cycle apparatus 50 of Embodiment 1. The refrigeration cycle apparatus 50 has a refrigerant circuit 51 through which a refrigerant circulates.

The refrigerant detection apparatus 100 has the following features.

(1) The refrigerant detection apparatus 100 can detect a refrigerant amount even when a subcooling degree SC=0° C. at an outlet of a condenser and a refrigerant state at the outlet of the condenser is a two-phase.

In the refrigerant detection apparatus 100, an output unit 115 to be described below presents a refrigerant leakage amount in a quantitative value "%", like the "leakage amount %" based on a "standard refrigerant amount (100%)".

The output unit 115 can display the refrigerant leakage amount on displays of a computer and a tablet terminal, for example. Therefore, since an operator knows a refrigerant filling amount to be added, an operation time can be reduced. Further, in an air conditioning system using a combustible refrigerant, since it is known whether or not the refrigerant has reached an ignition limit concentration, an appropriate response to leakage can be taken depending on an ignition risk. The appropriate response to leakage can be taken, such as whether to ventilate or evacuate, for example.

(2) When detecting the refrigerant amount, the refrigerant detection apparatus 100 operates a refrigeration cycle apparatus in a refrigerant amount detection mode.

(3) The refrigerant detection apparatus 100 indirectly detects the refrigerant amount using $A_L$% to be described below under a condition where the subcooling degree SC is greater than 0° C., and using $A_G$% to be described below under another condition (SC=0).

(4) The refrigerant detection apparatus 100 improves accuracy of the refrigerant detection amount, by adding to each of $A_L$% and $A_G$%, a correction of a "condensation temperature-outdoor air" ratio depending on a refrigerant circulation amount ratio.

The refrigerant detection apparatus 100 will be specifically described below.

As illustrated in FIG. 1, the refrigeration cycle apparatus 50 includes an outdoor unit 20 and an indoor unit 30. The refrigeration cycle apparatus 50 constitutes a refrigeration cycle. The outdoor unit 20 includes a compressor 1, a four-way valve 9, the outdoor heat exchanger 2, an outdoor fan 2A, an HIC 3, an HIC-LEV 4, and the accumulator 10. The HIC 3 is a Heat Inter Changer. The Heat Inter Changer is referred to as the HIC 3. The HIC 3 has a double pipe that exchanges heat with the refrigerant injected into the compressor 1 and with the refrigerant that flows to the outdoor heat exchanger 2. The HIC-LEV 4 is a linear expansion valve for the HIC 3. The linear expansion valve is referred to as an LEV. The indoor unit 30 includes an LEV 6, the indoor heat exchanger 7, and an indoor fan 7A. The LEV 6 is a linear expansion valve for the indoor heat exchanger 7.

The HIC-LEV 4 and the LEV 6 are expansion valves.

<Refrigerant Circuit 51>

The refrigerant circuit 51 will be described below. In the outdoor unit 20, the compressor 1, the four-way valve 9, the outdoor heat exchanger 2, and the HIC 3 are connected in this order by pipes. The HIC 3, the HIC-LEV 4, the HIC 3, the accumulator 10, and the compressor 1 are connected in this order by pipes. A gas pipe 8, the four-way valve 9, and the accumulator 10 are connected in this order by pipes. In the indoor unit 30, the liquid pipe 5, the LEV 6, the indoor heat exchanger 7, and the gas pipe 8 are connected in this order by pipes. The refrigerant circuit 51 is formed by connecting the outdoor unit 20 and the indoor unit 30 with the gas pipe 8 and the liquid pipe 5. A branch path passes through the HIC-LEV 4 from a branch point B1, passes through the HIC 3, and connects to a branch point B2. The LEV 6 is a first expansion valve and the HIC-LEV 4 is a second expansion valve.

<Flow of Refrigerant>

In Embodiment 1, the outdoor heat exchanger 2 functions as a condenser and the indoor heat exchanger 7 functions as an evaporator. A case where the outdoor heat exchanger 2 functions as the condenser and the indoor heat exchanger 7 functions as the evaporator is referred to as cooling operation. A flow of the refrigerant in the case where the outdoor heat exchanger 2 is the condenser will be described below. In FIG. 1, a plurality of arrows indicate flowing directions of the refrigerant. The refrigerant flows to the compressor 1, the four-way valve 9, and the outdoor heat exchanger 2, and exchanges heat with an outdoor air in the outdoor heat exchanger 2. The outdoor fan 2A is installed in the outdoor heat exchanger 2 to facilitate the heat exchange. The black portion of the outdoor heat exchanger 2 indicates the liquid refrigerant. The refrigerant that has flowed out of the outdoor heat exchanger 2 passes through the HIC 3, and branches to two directions at the branch point B1. The refrigerant branched to one side goes to the liquid pipe 5, and the refrigerant branched to the other side goes to the HIC-LEV 4. The refrigerant branched to the one side passes through the liquid pipe 5, flows into the LEV 6, and expands. The refrigerant that has flowed out of the LEV 6 flows into the indoor heat exchanger 7 that functions as the evaporator, and exchanges heat with an indoor air. The indoor fan 7A is installed in the indoor heat exchanger 7 to facilitate the heat exchange. The black portion of the indoor heat exchanger 7 indicates the liquid refrigerant. The refrigerant that has flowed out of the indoor heat exchanger 7 passes through the gas pipe 8, and flows into the four-way valve 9 of the outdoor unit 20. The refrigerant that has flowed out of the four-way valve 9 joins at the branch point B2, the refrigerant that has flowed out of the HIC 3, and flows into the accumulator 10. The refrigerant that has flowed out of the accumulator 10 flows into the compressor 1. The refrigerant branched to the other side at the branch point B1 flows into the HIC-LEV 4 and expands. The refrigerant that has flowed out of the HIC-LEV 4 flows into the HIC 3, and exchanges heat with the refrigerant that flows to the branch point B1 from the HIC 3. The refrigerant that has flowed out of the HIC 3 joins at the branch point B2, the refrigerant that flows from the four-way valve 9 to the branch point B2, and flows to the accumulator 10.

<Refrigerant Detection Apparatus 100>

A plurality of temperature sensors and a plurality of pressure sensors are installed in the refrigerant circuit 51 of the refrigeration cycle apparatus 50. Further, the refrigerant detection apparatus 100 is connected to the refrigeration cycle apparatus 50. The refrigerant detection apparatus 100 detects the refrigerant leakage amount in the refrigerant circuit 51. The refrigerant detection apparatus 100 acquires detection values of the plurality of temperature sensors and the plurality of pressure sensors disposed in the refrigerant circuit 51, and controls each of actuators of the refrigeration cycle apparatus 50, based on the acquired plurality of detection values. Each of the actuators here is the compressor 1, the outdoor fan 2A, the HIC-LEV 4, or the four-way valve 9, in the outdoor unit 20, and is the LEV 6 or the indoor fan 7A, in the indoor unit 30. Further, the refrigerant detection apparatus 100 acquires the detection values of the plurality of temperature sensors and the plurality of pressure sensors disposed in the refrigerant circuit 51, and detects the refrigerant leakage amount in the refrigerant circuit 51 based on the acquired plurality of detection values.

Details of the refrigerant detection apparatus 100 will be described below.

<Sensor>

The following ten types of sensors are disposed in the refrigerant circuit 51.

A reference sign of a sensor may be used as a detection value of the sensor in Embodiment 1.

(1) Pressure Sensor HS:

A pressure sensor HS is disposed on a discharge side of the compressor 1. The pressure sensor HS detects high pressure inside a pipe on the discharge side. A condensation temperature $T_c$ of the refrigerant can be obtained as a saturation temperature of the pressure detected by the pressure sensor HS.

(2) Pressure Sensor LS:

A pressure sensor LS is disposed on a suction side of the compressor 1. The pressure sensor LS detects low pressure inside a pipe on the suction side.

(3) Temperature Sensor TH2:

A temperature sensor TH2 is disposed at an outlet where the refrigerant that has flowed out of the HIC-LEV 4 flows out of the HIC 3. The temperature sensor TH2 detects an outlet temperature of the refrigerant that flows from the HIC-LEV 4 into the HIC 3, and flows out of the HIC 3.

(4) Temperature Sensor TH3:

A temperature sensor TH3 is disposed at an outlet of the outdoor heat exchanger 2. The temperature sensor TH3 detects an outlet temperature of the refrigerant of the outdoor heat exchanger 2 when the outdoor heat exchanger 2 functions as the condenser.

(5) Temperature Sensor TH4:

A temperature sensor TH4 is disposed on the discharge side of the compressor 1. The temperature sensor TH4 detects a temperature of the refrigerant discharged from the compressor 1.

(6) Temperature Sensor TH5:

A temperature sensor TH5 is disposed on the suction side of the compressor 1. The temperature sensor TH5 detects a temperature of the refrigerant that flows into the compressor 1.

(7) Temperature Sensor TH7:

A temperature sensor TH7 is disposed the circumstance of the outdoor fan 2A. The temperature sensor TH7 detects an ambient air temperature of the outdoor unit 20. That is, the temperature sensor TH7 detects an outdoor temperature.

(8) Frequency Sensor Sf:

A frequency sensor Sf is disposed in the compressor 1. The frequency sensor Sf detects a frequency of the compressor 1.

(9) Opening Sensor S4:

An opening sensor S4 is disposed in the HIC-LEV 4. The opening sensor S4 detects an opening of the HIC-LEV 4. The opening sensor S4 detects a pulse that controls the opening of the HIC-LEV 4.

(10) Opening Sensor S6:

An opening sensor S6 is disposed in the LEV 6. The opening sensor S6 detects an opening of the LEV 6. The opening sensor S6 detects a pulse that controls the opening of the LEV 6.

(11) Although the various sensors of (1) to (10) described above are disposed in the refrigeration cycle apparatus 50, a sensor other than these sensors may be disposed.

The refrigerant detection apparatus 100 will be described in detail. The refrigerant detection apparatus 100 includes an acquisition unit 111, a control unit 112, a determination unit 113, a calculation unit 114, and the output unit 115.

(1) The acquisition unit 111 acquires the detection values from the various sensors.

(2) The control unit 112 controls each of the actuators of the refrigeration cycle apparatus 50 based on the detection values of the various sensors acquired by the acquisition unit 111. Thereby, the control unit 112 controls operation of the refrigeration cycle apparatus 50.

(3) The determination unit 113 determines whether or not the subcooling degree SC is S>0 (kelvin). In other words, the determination unit 113 determines whether or not the subcooling degree SC is SC=0 (kelvin). SC=0 (kelvin) or SC=0° C. may be referred to as SC=0. Details will be described below. The subcooling degree SC may be simply referred to as SC. The unit of the subcooling degree SC may be kelvin or ° C.

(4) The calculation unit 114 calculates either the refrigerant amount based on a liquid phase area ratio $A_L$% or the refrigerant amount based on a gas phase area ratio $A_G$% depending on a determination result of the determination unit 113. The liquid phase area ratio $A_L$% indicates a liquid phase area ratio which is a liquid phase volume rate of a total volume of the outdoor heat exchanger 2 that functions as the condenser. The gas phase area ratio $A_G$% indicates a gas phase area ratio which is a gas phase volume rate of the total volume of the outdoor heat exchanger 2 that functions as the condenser. Hereinafter, the liquid phase area ratio $A_L$% and the gas phase area ratio $A_G$% may be simply referred to as $A_L$% and $A_G$%. Details of $A_L$% and $A_G$% will be described below. When SC=0, the calculation unit 114 calculates the refrigerant amount based on $A_G$%. When SC>0, the calculation unit 114 calculates the refrigerant amount based on $A_L$%.

(5) The output unit 115 outputs a calculation result of the calculation unit 114. The output of the calculation result by the output unit 115 is various, such as display to a display device, generation of sound by a sound generation device, or output of a calculation value to a storage device.

The operation of the cooling operation by the refrigeration cycle apparatus 50 will be described. In the cooling operation, the high-temperature and high-pressure gas refrigerant discharged from the compressor 1 passes through the four-way valve 9 to reach the outdoor heat exchanger 2 and then is condensed. The condensation temperature $T_c$ at this time can be obtained as the saturation temperature of the pressure of the pressure sensor HS attached to the discharge side of the compressor 1. Further, the subcooling degree of the refrigerant at the outlet of the outdoor heat exchanger 2 is obtained from a difference between the condensation temperature $T_c$ and the temperature sensor TH3. The condensed refrigerant passes through the HIC 3. The refrigerant branched to the one side at the branch point B1 flows through the liquid pipe 5 into the LEV 6.

The refrigerant branched to the one side will be described. The refrigerant that has flowed into the LEV 6 is decompressed. The refrigerant that has left the LEV 6 evaporates in the indoor heat exchanger 7. After that, the refrigerant returns to the compressor 1 via the gas pipe 8, the four-way valve 9, the branch point B2, and the accumulator 10.

The refrigerant branched to the other side at the branch point B1 flows into the HIC-LEV 4. The refrigerant that has flowed out of the HIC-LEV 4 exchanges heat at the HIC 3, with the refrigerant that has flowed out of the outdoor heat exchanger 2, and returns to the compressor 1 via the branch point B2 and the accumulator 10.

*Description of Operation*

Figure 2:
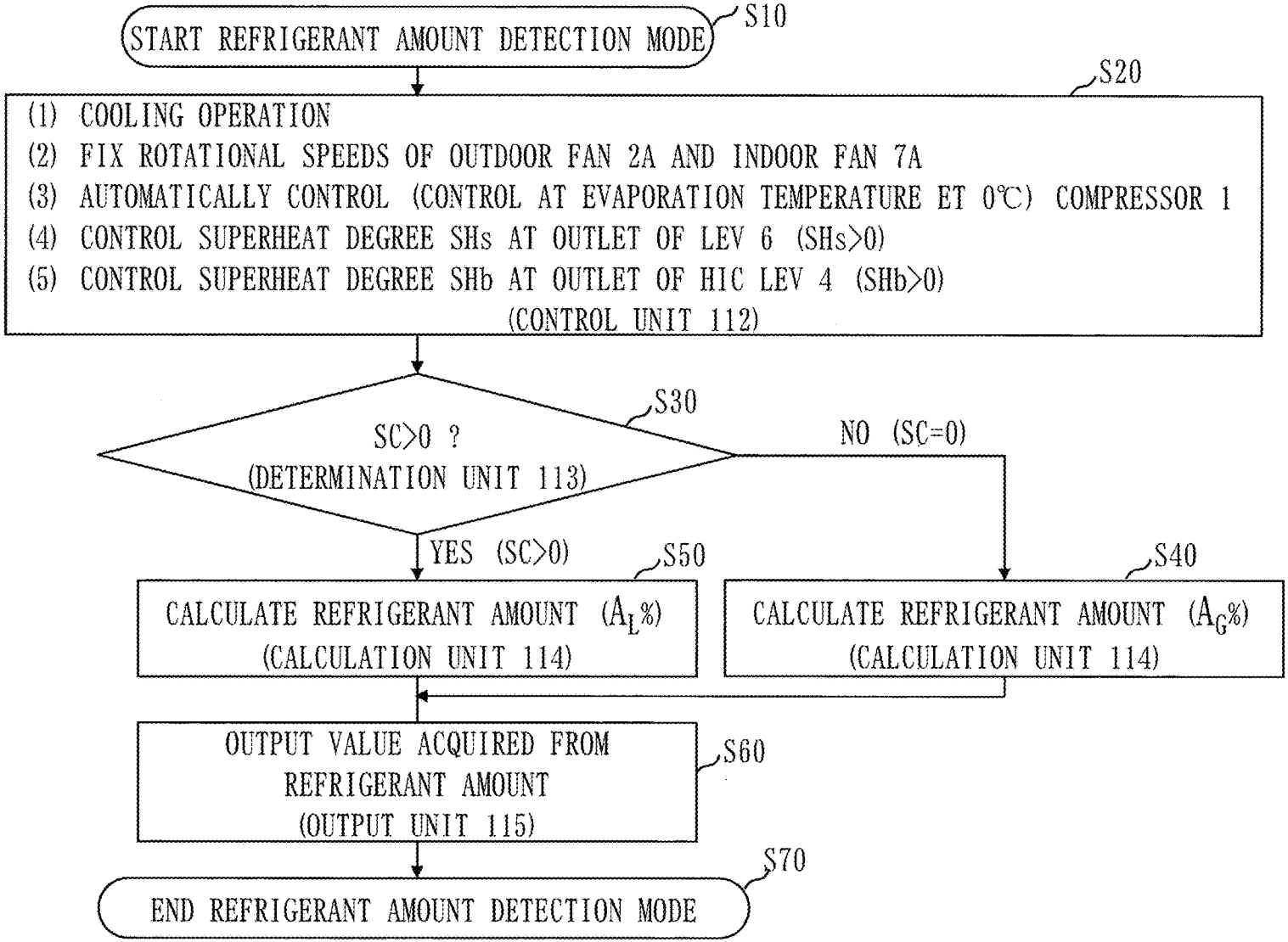
FIG. 2 is a diagram of Embodiment 1 and is a flowchart of operation of a refrigerant detection apparatus 100.

FIG. 2 is a flowchart of operation of detecting the refrigerant leaked in the refrigerant circuit 51, performed by the refrigerant detection apparatus 100. The refrigerant detection operation by the refrigerant detection apparatus 100 will be described with reference to FIG. 2.

<Step S10>

In step S10, the control unit 112 starts the operation of the refrigeration cycle apparatus 50 in the refrigerant amount detection mode.

<Step S20>

Step S20 indicates control of the refrigerant amount detection mode by the control unit 112. Each of the control of (1) to (5) indicated in step S20 of FIG. 2 has the following effects. That is, in order to improve detection accuracy of the refrigerant amount using $A_L$% and $A_G$%, it is preferable that distribution of the liquid refrigerant in the refrigerant circuit 51 does not depend on an environmental condition and an operational state. The gas refrigerant is inside the accumulator 10 by the control of (1) to (5) of step S20. Therefore, most of the liquid refrigerant can stay in the liquid pipe 5 and the outdoor heat exchanger 2 which is the condenser. Further, a refrigerant temperature of the liquid pipe 5 is substantially constant by the control to the HIC-LEV 4 by the control unit 112. Therefore, it is possible to avoid a change in refrigerant density in the liquid pipe 5, due to a difference in the outdoor air. The control from (1) to (5) will be specifically described.

In step S20, the control unit 112 controls each of the actuators of the refrigeration cycle apparatus 50, using the detection values of the various sensors acquired by the acquisition unit 111. Thereby, the control unit 112 operates the refrigeration cycle apparatus 50 in the refrigerant amount detection mode.

(1) The control unit 112 performs the cooling operation of the refrigeration cycle apparatus 50. Therefore, the outdoor heat exchanger 2 functions as the condenser and the indoor heat exchanger 7 functions as the evaporator.

(2) The control unit 112 fixes rotations of the outdoor fan 2A and the indoor fan 7A at full speeds. A feature is that all of the fans are fixed at the full speeds. A change in the refrigerant amount in the outdoor heat exchanger 2 due to a change in the refrigerant filling amount is directly linked to pressure and temperature around the outdoor heat exchanger 2 by setting all of the fans at the full speeds, and the detection accuracy of the refrigerant amount using such as $A_L$% and $A_G$% is improved. If a fan speed changes, the detection accuracy of the refrigerant amount decreases since it is not known whether the pressure and temperature have changed due to the change in the refrigerant filling amount or the pressure and temperature have changed due to the change in the fan speed.

(3) The control unit 112 automatically controls (controls at an evaporation temperature ET 0° C.) the compressor 1.

(4) The control unit 112 controls a superheat degree SHs at an outlet of the LEV 6, by controlling the LEV 6. The control unit 112 controls the LEV 6 so that the superheat degree SHs of the LEV 6 is equal to or greater than 0° C.

(5) The control unit 112 controls a superheat degree SHb at an outlet of the HIC-LEV 4, by controlling the HIC-LEV 4. The control unit 112 controls the HIC-LEV 4 so that the superheat degree SHb of the HIC-LEV 4 is equal to or greater than 0° C.

<Step S30>

In step S30, the determination unit 113 determines whether or not SC>0. In other words, the determination unit 113 determines whether the outlet of the outdoor heat exchanger 2 that functions as the condenser is in a subcooling state or a two-phase state. The subcooling degree is obtained by SC=Tc−TH3. When the subcooling degree SC=0, the process proceeds to step S40. When the subcooling degree SC>0, the process proceeds to step S50. However, the outlet of the condenser may be in the two-phase state even if SC>0 due to an effect such as a detection error of the temperature sensors and the pressure sensors or a refrigerant pressure loss. Therefore, the determination formula of step S30 may be set to SC>0.5, for example. Note that 0.5 in SC>0.5 is an example. It is not limited to 0.5, and a value greater than zero may be adopted instead of 0.5. A feature of the refrigerant detection apparatus 100 is particularly in step S40. In step S40, the calculation unit 114 calculates $A_G$%, and calculates the refrigerant amount in the refrigerant circuit 51 using $A_G$%. In step S50, the calculation unit 114 calculates $A_L$%, and calculates the refrigerant amount in the refrigerant circuit 51 using $A_L$%. The calculation unit 114 calculates the refrigerant amount based on $A_G$% and the refrigerant amount based on $A_L$%, using the various detection values acquired by the acquisition unit 111.

<Description of $A_L$% and $A_G$%>

Since $A_L$% and $A_G$% have common and similar portions, they will be described together.

First, the following (Formula 1) to (Formula 5) are indicated for $A_L$% and $A_G$%.

$$A_L\,\% = -\mathrm{Ln}\left(1 - SC/dT_c\right) * \left\{dT_c * [dT_{c_corr}]^{-1} * C'_{pL}\right\}/\Delta h_{con} \quad \text{(Formula 1)}$$

$$A_G\,\% = -\mathrm{Ln}\left(dT_c/(dT_c + SH_d)\right) * \left\{dT_c \cdot [dT_{c_corr}]^{-1} * C'_{pg}\right\}/\Delta h_{con} \quad \text{(Formula 2)}$$

$$C'_{pL} = f_1\left(dT_c * [dT_{c_corr}]^{-1} + TH7\right) \quad \text{(Formula 3)}$$

$$C'_{pg} = f_2\left(dT_c * [dT_{c_corr}]^{-1} + TH7\right) \quad \text{(Formula 4)}$$

$$dT_{c_corr} = A * (G_{r_ratio})^B \quad \text{(Formula 5)}$$

The meaning of the symbols in each of the formulas is as follows.

(a) SC:

The subcooling degree SC is a difference between the condensation temperature $T_c$ and the outlet temperature TH3 of the outdoor heat exchanger 2. That is, SC=$T_c$−TH3. The outlet temperature TH3 is a liquid temperature when SC>0.

The condensation temperature $T_c$ is also referred to as a condensation temperature. The condensation temperature $T_c$ can be obtained by converting the detection value of the pressure sensor HS into a saturated gas temperature. The determination unit 113 converts the detection value of the pressure sensor HS into the saturated gas temperature, using a physical property table for converting pressure into temperature. An auxiliary storage device 130 stores the physical property table.

The outlet temperature TH3 is the detection value of the temperature sensor TH3.

The determination unit 113 calculates the subcooling degree SC and determines whether or not the subcooling degree SC is greater than zero.

(b) $dT_c$:

$dT_c$ is a difference between the condensation temperature $T_c$ and the outdoor temperature TH7. That is, $dT_c$=$T_c$−TH7. $dT_c$ is a first temperature difference.

TH7 is detected by the temperature sensor TH7.

(c) $[dT_{c_corr}]^{-1}$ $[dT_{c_corr}]^{-1}$ is a correction value of $dT_c$. As indicated in the above (Formula 5), $[dT_c_com]^{-1}$ is a correction coefficient of $dT_c$ decided from a refrigerant circulation ratio $G_{r_ratio}$.

$[dT_{c_corr}]^{-1}$ is a reciprocal value of $dT_{c_corr}$.

$dT_{c_corr}$ can be obtained as follows.

As described in (Formula 5), $$dT_{c_corr} = A * (G_{r_ratio})^B$$

where A and B are constant values.

$$G_{r_ratio} = \text{refrigerant circulation amount } G_r \div \text{standard refrigerant circulation amount } G_{std} \quad \text{(Formula 5.1)}$$

The standard refrigerant circulation amount $G_{std}$ is a set value for the refrigerant circuit 51. The meaning of $G_{r_ratio}$ is as follows. $G_{r_ratio}$ is a ratio of the refrigerant circulation amount $G_r$ to the standard refrigerant circulation amount $G_{std}$ (refrigerant circulation amount during rated capacity operation kg/h) when $A_L$% or $A_G$% is calculated. In a device with a rated capacity of 28 kW (circulation amount 614 kg/h), $G_{r_ratio}$ is 0.5 when the device is operated at the circulation amount of 307 kg/h during $A_L$% calculation, for example. The standard refrigerant circulation amount $G_{std}$ is a known set value. The refrigerant circulation amount $G_r$ is an amount relating to the compressor 1 and can be calculated by (Formula 5.2). The meaning of the symbols in (Formula 5.2) is described below, $$G_r(\mathrm{kg/s}) = S_t * \rho_s * f * \eta_v \quad \text{(Formula 5.2)}$$

$S_t$: excluded volume, $\rho_s$: suction density, f: compressor frequency, $\eta_v$: volumetric efficiency. The calculation unit 114 can calculate $dT_{c_corr}$ by (Formula 5), (Formula 5.1) and (Formula 5.2).

That is, (Formula 5.3) is obtained.

$$G_{r_ratio} = S_t * \rho_s * f * \eta_v \div G_{std} \quad \text{(Formula 5.3)}$$

In (Formula 5.3), $S_t$, $\eta_v$ and $G_{std}$ are not parameters whose values are decided from the detection values of the sensors. $S_t$, $\eta_v$ and $G_{std}$ are specification values.

$\rho_s$ is decided according to a physical property table from the detection value of the temperature sensor TH5. The auxiliary storage device 130 stores this physical property table.

f is decided from the detection value of the frequency sensor Sf.

More specifically, $S_t$ denotes the excluded volume. $S_t$ is stroke volume and indicates volume of suction gas taken in by the compressor 1 per rotation. $\eta_v$ is the volumetric efficiency. $S_t$ is volume obtained geometrically, and actual effective volume is $S_t \times \eta_v$. f is the number of rotations of the compressor. When $G_{r_ratio}$ is decided, $[dT_{c_corr}]$ is decided by (Formula 5).

As described above, the calculation unit 114 calculates the correction coefficient $[dT_{c_corr}]^{-1}$ that corrects the first temperature difference $dT_c$. The correction coefficient $[dT_{c_corr}]^{-1}$ is decided based on the circulation amount of the refrigerant in the refrigerant circuit 51 decided from a specification of the compressor 1 and an operational state of the compressor 1, and based on the standard refrigerant circulation amount decided as a specification of the refrigerant circuit 51. The calculation unit 114 corrects the first temperature difference $dT_c$ with the decided correction coefficient $[dT_{c_corr}]^{-1}$.

(d) $C'_{pL}$ $C'_{pL}$ is a specific heat of the liquid refrigerant. $C'_{pL}$ is calculated by the above (Formula 3). TH7 in (Formula 3) is the detection value of the temperature sensor TH7 that detects the outdoor temperature. $f_1$ in (Formula 3) indicates a function. $C'_{pL}$ is a value decided from refrigerant physical properties. That is, $C'_{pL}$ is obtained by substituting $dT_c$ obtained by the above (b), $[dT_{c_corr}]^{-1}$ obtained by the above (c), and the detection value of the detection sensor TH7, into the function $f_1$. $C'_{pL}$ is the specific heat at constant pressure liquid.

(e) $\Delta h_{con}$ $\Delta h_{con}$ in (Formula 1) and (Formula 2) is an enthalpy difference between an inlet and an outlet of the condenser.

That is, $\Delta h_{con}$ is an enthalpy difference between the inlet and the outlet of the outdoor heat exchanger 2. Since SC>0 in (Formula 1), the outlet of the outdoor heat exchanger 2 is in a liquid phase, and the inlet of the outdoor heat exchanger 2 is in a gas phase. Therefore, enthalpy at the inlet and the outlet is decided from a temperature T and pressure P of the refrigerant.

Specifically, the enthalpy at the inlet of the outdoor heat exchanger 2 is obtained from the detection value of the pressure sensor HS and the detection value of the temperature sensor TH4.

The enthalpy at the outlet of the outdoor heat exchanger 2 is obtained from the detection value of the pressure sensor HS and the detection value of the temperature sensor TH3.

When the refrigerant is in a single-phase, among six values of refrigerant physical properties, that is, among pressure, temperature, density, enthalpy, entropy, and dryness, if two of the six values of the physical properties are specified, the other four values are confirmed.

Since the temperature sensors and the pressure sensors are installed in the refrigeration cycle apparatus, the values of the physical properties of the refrigerant are obtained from the temperature and pressure.

When the refrigerant is in the two-phase state, the temperature is stable under constant pressure. Therefore, the values of the physical properties such as the enthalpy and the density are obtained by specifying the dryness, like saturated gas (dryness 1) and saturated liquid (dryness 0).

(f) $SH_d$ $SH_d$ in (Formula 2) is a difference between the discharge temperature TH4 of the refrigerant and the condensation temperature (saturated gas temperature) $T_c$.

That is, $$SH_d = TH4 - T_c$$

$SH_d$ is obtained from detection values of the temperature sensor TH4 and the pressure sensor HS.

$SH_d$ is a second temperature difference.

(g) $C'_{pg}$ $C'_{pg}$ is a specific heat of the gas refrigerant. $C'_{pg}$ is calculated by the above (Formula 4). The calculation of $C'_{pg}$ is similar to that of $C'_{pL}$. In contrast with $f_1$ in (Formula 3), there is a function $f_2$ in (Formula 4). $C'_{pg}$ is also a value decided from the refrigerant physical properties. That is, $C'_{pg}$ is obtained by substituting $dT_c$, $[dT_{c_corr}]^{-1}$, and TH7 into the function $f_2$. $C'_{pg}$ is the specific heat at constant pressure gas.

<Calculation of $\Delta h_{con}$ of (Formula 2)>

The calculation unit 114 calculates the enthalpy difference $\Delta h_{con}$ of the refrigerant at the subcooling degree SC=0, based on openings of expansion valves, the suction pressure LS of the compressor 1, the discharge pressure HS of the compressor 1, and the circulation amount $G_r$ total of the refrigerant.

The expansion valves are the HIC-LEV 4, and LEVs 6-1, 6-2, and 6-3. Since (Formula 2) is calculation of $A_G$%, the subcooling degree SC is SC=0. That is, the refrigerant at the outlet of the outdoor heat exchanger 2 which is the condenser is in the two-phase. When a state of the refrigerant at the outlet of the condenser is the two-phase, the enthalpy at the outlet of the condenser cannot be calculated from the temperature and pressure. Therefore, the enthalpy of the refrigerant at the outlet of the outdoor heat exchanger 2 is estimated by the following method. Note that the refrigerant at the inlet of the outdoor heat exchanger 2 is in the gas phase. Therefore, the enthalpy of the refrigerant at the inlet can be calculated from the temperature and pressure as with the case of (Formula 1).

(Formula 6) to (Formula 13) will be indicated below.

Figure 3:
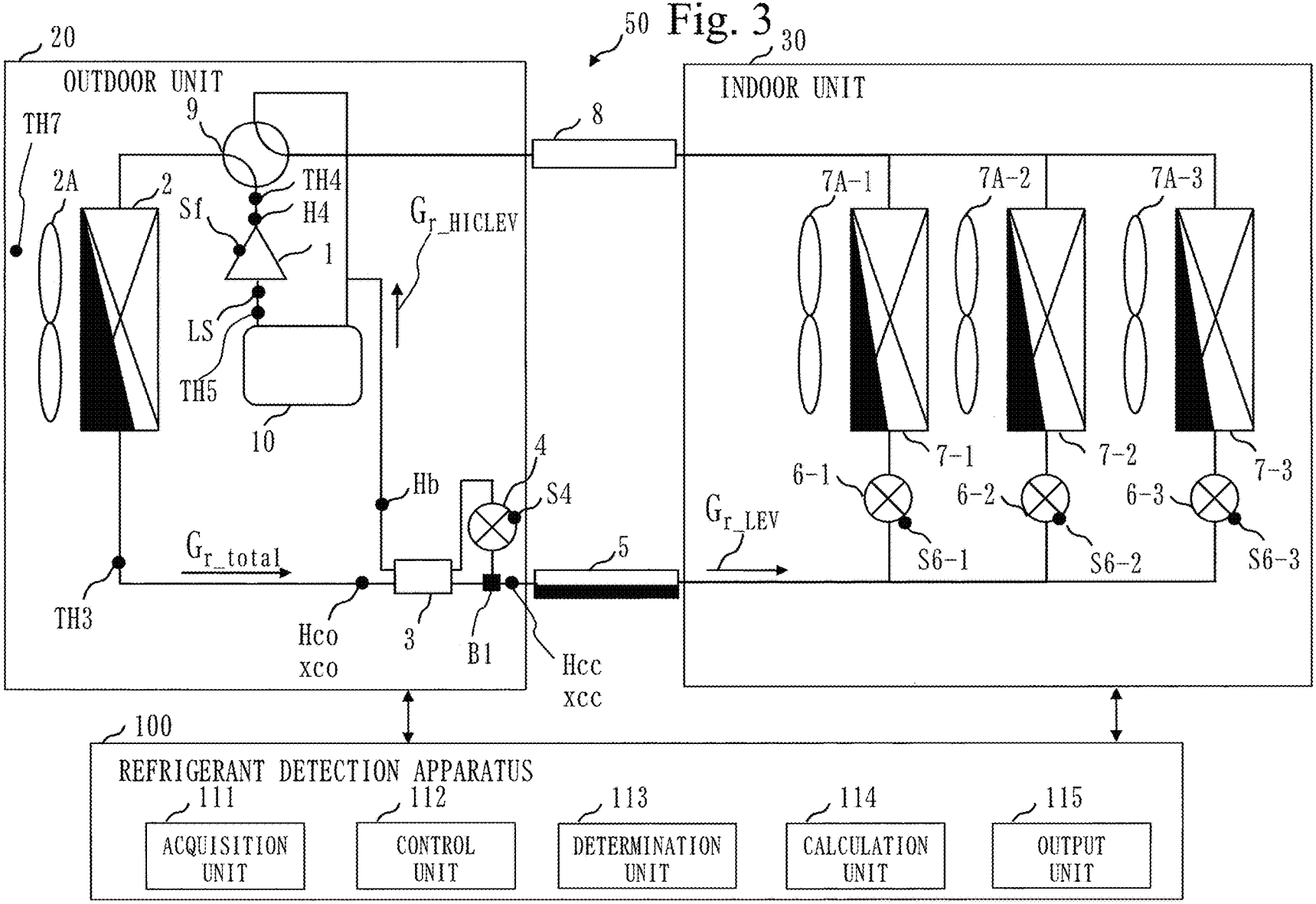
FIG. 3 is a diagram of Embodiment 1 and is a diagram illustrating a configuration in which the refrigeration cycle apparatus 50 has a plurality of indoor heat exchangers.

(Formula 6) to (Formula 13) assume the refrigeration cycle apparatus 50 of FIG. 3.

FIG. 3 illustrates a configuration in which the refrigeration cycle apparatus 50 has a plurality of indoor heat exchangers. The refrigeration cycle apparatus 50 includes an indoor heat exchanger 7-1. The LEV 6-1 and an indoor fan 7A-1 are disposed in the indoor heat exchanger 7-1. Similarly, the LEV 6-2 and an indoor fan 7A-2 are disposed in an indoor heat exchanger 7-2, and the LEV 6-3 and an indoor fan 7A-3 are disposed in an indoor heat exchanger 7-3. Opening sensors S6-1, S6-2, and S6-3 are disposed in the LEVs 6-1, 6-2, and 6-3, respectively. The refrigerant flows into the LEV 6-1, and then branches to the indoor heat exchangers 7-1, 7-2, and 7-3.

In the following (Formula 6) to (Formula 13), (Formula 6) and (Formula 11) are conclusively represented by an unknown number xco and an unknown number xcc.

xco is dryness of the refrigerant at the outlet of the outdoor heat exchanger 2 which is the condenser.

xcc is dryness of the refrigerant at the outlet on the high-pressure side of the HIC 3.

xco and xcc are parameters.

Then, the calculation unit 114 performs convergence calculation for the parameters xco and xcc so that (Formula 6) and (Formula 11) are established. A value decided from the parameter xco or the parameter xcc is represented like $<\rho_{m_co}>$.

Since $\rho_{m_HICLEV}$ is decided from xcc as in (Formula 7), $\rho_{m_HICLEV}$ can be represented as $<\rho_{m_HICLEV}>$.

Since $\rho_{m_co}$ is decided from xco as in (Formula 9), $\rho_{m_co}$ can be represented as $<\rho_{m_co}>$.

$G_r$ total in (Formula 6) is the same as $G_r$ in (Formula 5.2).

$$G_{r_total} = G_{r_LEV} + G_{r_HICLEV} \quad \text{(Formula 6)}$$

$$G_{r_total} = S_t * \rho_s * f * \eta_v \quad \text{(Formula 6.1)}$$

$$G_{r_LEV} = \sum\{C_{v_LEV} * \{ < \rho_{m_co} > * (HS - LS)\}^{1/2} \quad \text{(Formula 6.2)}$$

$$G_{r_HICLEV} = \{C_{v_HICLEV} * \{ < \rho_{m_HICLEV} > * (HS - LS)\}^{1/2} \quad \text{(Formula 6.3)}$$

(Formula 6) indicates the following meaning.

(Formula 6) represents a mass conservation law that indicates that the refrigerant circulation amount $G_{r_total}$ of the compressor 1 equals to a total value of the refrigerant circulation amount $G_r$ LEV that flows through each of the indoor heat exchangers indicated in (Formula 6.2) and the refrigerant circulation amount $G_{r_HICLEV}$ that flows through the HIC 3 indicated in (Formula 6.3). 2 in (Formula 6.2) relates to each of the indoor heat exchangers 7. $G_{r_total}$ on the left side is the refrigerant circulation amount obtained from the specification and the number of rotations of the compressor 1 as indicated in (Formula 6.1).

The right side of (Formula 6) is a total of the refrigerant circulation amount $G_r$ LEV that passes through the LEV of each of the indoor heat exchangers and the refrigerant circulation amount $G_{r_HICLEV}$ that passes through the HIC-LEV 4.

The meaning of each of the symbols is as follows.

$C_{v_LEV}$: flow coefficient according to the opening of the LEV 6.

$C_{v_LEV}$ is a specification value for calculating from the refrigerant density at the inlet of the LEV 6 and a pressure difference between the inlet and the outlet of the LEV 6, a refrigerant flow amount that passes through the LEV 6.

$\rho_{m_co}$: refrigerant density at the outlet of the outdoor heat exchanger 2.

$C_{v_HICLEV}$: flow coefficient according to the opening of the HIC-LEV 4.

$C_{v_HICLEV}$ is a specification value for calculating from the refrigerant density at the inlet of the HIC-LEV 4 and a pressure difference between the inlet and the outlet of the HIC-LEV 4, a refrigerant flow amount that passes through the HIC-LEV 4.

$\rho_{m_HICLEV}$: refrigerant density at the inlet of the HIC-LEV 4.

The following (Formula 7) to (Formula 10) are $\rho_{m_HICLEV}$ and the like included in (Formula 6.2) and (Formula 6.3).

$$\rho_{m_HICLEV} = \{xcc/\rho_g + (1 - xcc)/\rho_L\}^{-1} \quad \text{(Formula 7)}$$

$$C_{v_HICLEV} = f_3(HICpulse) \quad \text{(Formula 8)}$$

$$\rho_{m_co} = \{xco/\rho_g + (1 - xco)/\rho_L\}^{-1} \quad \text{(Formula 9)}$$

$$C_{v_LEV} = f_4(\text{pulse}) \quad \text{(Formula 10)}$$

The meaning of each of the symbols is as follows.

$\rho_g$: saturated gas density at high pressure (HS).

$\rho_L$: saturated liquid density at high pressure (HS).

HICpulse: opening of the HIC-LEV 4.

pulse: opening of the LEV 6.

Here, the saturated gas density pg is obtained from the detection value of the sensor HS on the discharge side and a table for obtaining the saturated gas density $\rho_g$ from the detection value. The calculation unit 114 obtains the saturated gas density $\rho_g$. Similarly, the saturated liquid density $\rho_L$ is obtained from the detection value of the sensor HS on the discharge side and a table for obtaining the saturated liquid density $\rho_L$ from the detection value. The calculation unit 114 obtains the saturated liquid density $\rho_L$.

(Formula 7) is the refrigerant density at a time when the inlet of the HIC-LEV 4 is in the gas-liquid two-phase, and the gas and the liquid are uniformly mixed.

(Formula 7) is a calculation formula of the refrigerant density at a time when the refrigerant dryness on the inlet of the HIC-LEV 4 is xcc.

(Formula 9) is a calculation formula of the refrigerant density at a time when the refrigerant dryness on the outlet of the outdoor heat exchanger 2 is xco.

(Formula 8) is a formula that indicates that when the opening of the HIC-LEV 4 is decided, $C_{v_HICLEV}$ is decided from a specification $f_3$ of the HIC-LEV 4. That is, $C_{v_HICLEV}$ is decided from the detection value of the opening sensor S4 and the specification $f_3$.

(Formula 10) is a formula that indicates that when the opening of the LEV 6 is decided, $C_{v_LEV}$ is decided from a specification $f_4$ of the LEV 6. That is, $C_{v_LEV}$ is decided from the detection value of the opening sensor S6 and the specification $f_4$.

(Formula 11) will be represented next.

$$G_{r_total} * (< Hco(xco) > - < Hcc(xcc) >) = < G_{r_HICLEV}(xcc) > * (< Hco(xco) > - Hb) \quad \text{(Formula 11)}$$

(Formula 11) means that a heat exchange amount on the high-pressure side of the HIC 3 equals to a heat exchange amount on the low-pressure side of the HIC 3.

The meaning of Hco, Hcc, and Hb is as follows.

Hco: enthalpy of the refrigerant at the outlet of the outdoor heat exchanger 2.

Hcc: enthalpy of the refrigerant at the outlet on the high-pressure side of the HIC 3.

Hb: enthalpy of the refrigerant on the low-pressure side of the HIC 3.

Hco and Hcc are represented by the following (Formula 12) and (Formula 13).

Hb can be decided from the detection value of the temperature sensor TH2 and the detection value of the pressure sensor LS.

$$Hco = f_5(HS, < xco >) \quad \text{(Formula 12)}$$

$$Hcc = f_6(HS, < xcc >) \quad \text{(Formula 13)}$$

(Formula 12) and (Formula 13) are decided from refrigerant physical properties.

$f_5$ and $f_6$ indicate physical properties. The auxiliary storage device 130 stores a physical property table for each of $f_5$ and $f_6$.

Therefore, xco and xcc are unknown values in (Formula 6) and (Formula 11). (Formula 6) and (Formula 11) are represented as follows by specifying xco and xcc.

$$S_t * \rho_s * f * \eta_v = \sum \{C_{v_LEV} * \{ < \rho_{m_co}(xco) > * (HS - LS)\}^{1/2} + \{C_{v_HICLEV} * \{ < \rho_{m_HICLEV}(xcc) > * (HS - LS)\}^{1/2} \quad \text{(Formula 6)}$$

$$G_{r_total} * \left( < Hco(xco) > - < Hcc(xcc) > \right) = < G_{r_HICLEV}(xcc) > * \left( < Hco(xco) > - Hb \right) \quad \text{(Formula 11)}$$

xco is obtained by performing the convergence calculation on (Formula 6) and (Formula 11) represented using xco and xcc. The enthalpy Hco of the refrigerant at the outlet of the outdoor heat exchanger 2 can be calculated by substituting obtained xco into (Formula 12).

Further, the enthalpy of the refrigerant on the inlet side of the outdoor heat exchanger is obtained in the same manner as in the case of $\Delta h_{con}$ in (Formula 1). In the cases of (Formula 1) and (Formula 2), the enthalpy of the refrigerant on the inlet side of the outdoor heat exchanger 2 may be obtained by substituting the discharge temperature and pressure of the compressor 1. Thus, $\Delta h_{con}$ in (Formula 2) can be obtained.

When $\Delta h_{con}$ is decided, a value of $A_G$% in (Formula 2) is decided.

<Step S40>

When SC=0, the process proceeds to step S40. In step S40, the calculation unit 114 calculates $A_G$% indicated in (Formula 1) according to the contents described in (Formula 1) to (Formula 13), using the various detection values acquired by the acquisition unit 111. $A_G$% calculated by the calculation unit 114 is referred to as calculated $A_G$%. The calculation unit 114 compares the calculated gas phase area ratio $A_G$% with an $A_G$ standard value set as a standard for $A_G$%, and calculates the refrigerant amount in the refrigeration cycle apparatus 50 based on a comparison result. The $A_G$ standard value is a value that can be compared with the calculated $A_G$%, and is a value that can be used to calculate from the comparison result, the refrigerant amount correlating with the calculated $A_G$%. An example of the $A_G$ standard value is $A_G$% calculated in the past by the calculation unit 114. Then, this $A_G$% calculated in the past is correlated with the refrigerant amount. The refrigeration cycle apparatus 50 is test operated at 80% of the standard refrigerant amount required for the refrigerant circuit 51, and the calculation unit 114 calculates as the $A_G$ standard value, $A_G$% during the test operation, for example. $A_G$% obtained during this test operation can be used as the $A_G$ standard value. $A_G$% during the test operation is correlated with the refrigerant amount that is 80% of the standard refrigerant amount.

The auxiliary storage device 130 to be described below stores the $A_G$ standard value.

<Step S50>

When SC>0, the process proceeds to step S50. In step S50, when the determination unit 113 determines that the subcooling degree SC is greater than zero kelvin, the calculation unit 114 calculates the liquid phase area ratio $A_L$% which is the liquid phase volume rate of the total volume of the condenser, using the obtained subcooling degree SC, the first temperature difference $dT_c$, the enthalpy difference $\Delta h_{con}$ of the refrigerant, the specific heat at constant pressure liquid $C'_{pL}$ of the refrigerant, and the correction coefficient $dT_{c_corr}$. The calculation unit 114 compares the calculated liquid phase area ratio $A_L$% with an $A_L$ standard value set as a standard for the liquid phase area ratio, and calculates the refrigerant amount in the refrigeration cycle apparatus 50 based on a comparison result.

A specific description will be given below.

In step S50, the calculation unit 114 calculates $A_L$% indicated in (Formula 1) according to the contents described in (Formula 1) to (Formula 13), using the various detection values acquired by the acquisition unit 111. $A_L$% calculated by the calculation unit 114 is referred to as calculated $A_L$%. The calculation unit 114 compares the calculated $A_L$% with the $A_L$ standard value set as the standard for $A_L$%. The $A_L$ standard value is a value that can be compared with the calculated $A_L$%, and is a value that can be used to calculate from the comparison result, the refrigerant amount correlating with the calculated $A_L$%.

The $A_L$ standard value is $A_L$% calculated in the past by the calculation unit 114. Then, this $A_L$% calculated in the past is correlated with the refrigerant amount. $A_L$% calculated by the calculation unit 114 for the refrigeration cycle apparatus 50 having the standard refrigerant amount as at installation can be used as the $A_L$ standard value, for example. This $A_L$% is correlated with the standard refrigerant amount. The auxiliary storage device 130 to be described below stores the $A_L$ standard value.

<Step S60>

In step S60, the output unit 115 outputs a value obtained from the refrigerant amount calculated by the calculation unit 114. The output unit 115 may display the value as output, on a display device.

As for the value obtained from the calculated refrigerant amount, when the refrigerant amount calculated by the calculation unit 114 is greater than the standard refrigerant amount, the output unit 115 may output as an excess refrigerant amount, a difference between the calculated refrigerant amount and the standard refrigerant amount. When the refrigerant amount calculated by the calculation unit 114 is less than the standard refrigerant amount, the output unit 115 may outputs as a leakage refrigerant amount, a difference between the calculated refrigerant amount and the standard refrigerant amount. Alternatively, the output unit 115 may output as a current refrigerant amount, the refrigerant amount itself calculated by the calculation unit 114.

An output form by the output unit 115 may be a ratio such as %, or a refrigerant amount such as kg. The output form of the output unit 115 may be any value such as proportion or mass, as long as the detected refrigerant amount, the excess refrigerant amount, and the leaked refrigerant are known.

<Step S70>

In step S70, the refrigerant amount detection mode ends.

Figure 4:
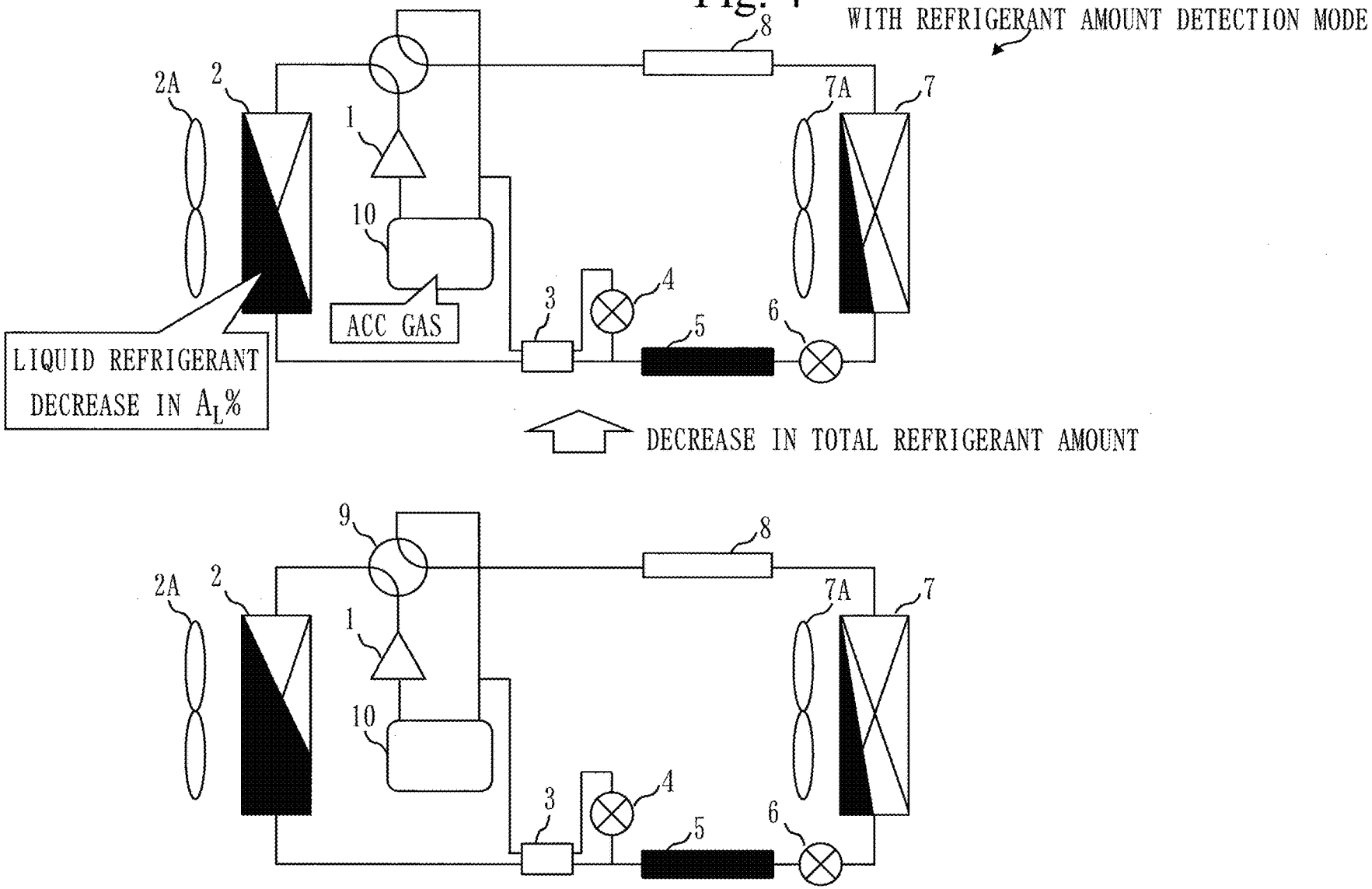
FIG. 4 is a diagram of Embodiment 1 and is a diagram illustrating an effect of a refrigerant amount detection mode at a time when there is the refrigerant amount detection mode of step S20.

FIG. 4 illustrates an effect of the refrigerant amount detection mode at a time when there is the refrigerant amount detection mode of step S20.

Figure 5:
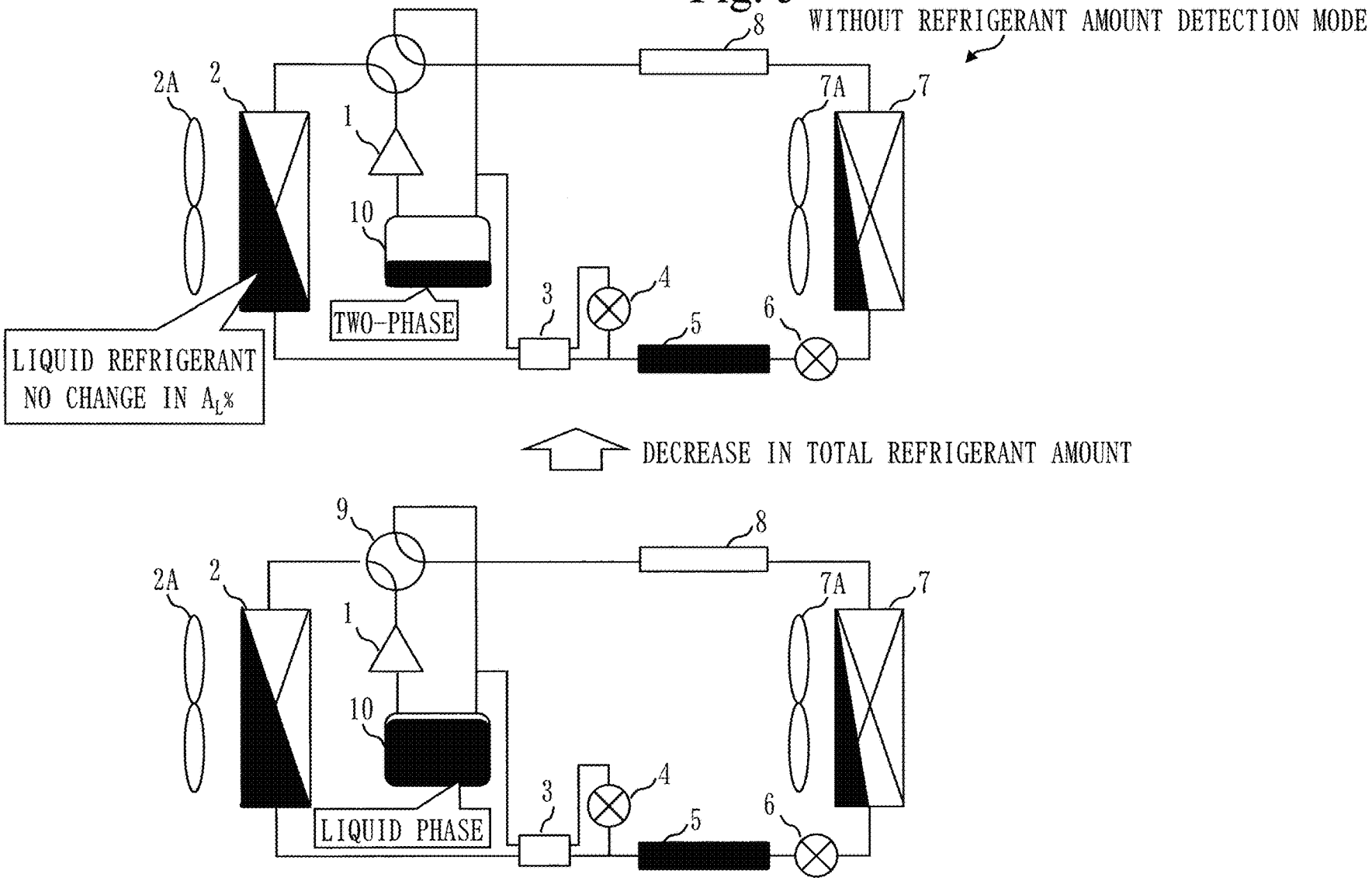
FIG. 5 is a diagram of Embodiment 1 and is a diagram of a comparison example of FIG. 4 without the refrigerant amount detection mode of step S20.

FIG. 5 is a comparison example of FIG. 4 without the refrigerant amount detection mode of step S20. In FIGS. 4 and 5, the upper side diagrams illustrate a state in which the total refrigerant amount has decreased from a state on the lower side. Although $A_L$% is illustrated in FIGS. 4 and 5, the following description also applies to $A_G$%. When there is the refrigerant amount detection mode, the refrigerant in the accumulator 10 is gasified as illustrated in FIG. 4. Therefore, a decrease in the refrigerant amount appears in the outdoor heat exchanger 2. When there is no refrigerant amount detection mode, the liquid phase refrigerant is in the accumulator 10 as illustrated in FIG. 5. Therefore, when the total refrigerant amount decreases, the liquid phase refrigerant amount in the accumulator 10 decreases in FIG. 5, the decrease in the total refrigerant amount dose not easily appear in the outdoor heat exchanger 2. Therefore, since the decrease in the total refrigerant amount does not easily appear in the outdoor heat exchanger 2 when there is no refringent amount detection mode, the detection accuracy of the refrigerant leakage amount is lowered. That is, in order to improve the detection accuracy of the refrigerant amount using $A_L$% and $A_G$%, it is preferable that the liquid temperature at the outlet of the high-pressure condenser or the gas temperature at the outlet of the high-pressure condenser changes only with a change in the refrigerant amount. Further, it is preferable that distribution of the refrigerant amount does not depend on an environmental condition and an operational state. The gas refrigerant is in the accumulator 10 by performing the control of (1) to (5) of the refrigerant amount detection mode of step S20. Therefore, most of the refrigerant can be retained in the liquid pipe 5 and the outdoor heat exchanger 2 which is the condenser. Further, the refrigerant temperature of the liquid pipe 5 can be kept substantially constant by an HIC-LEV control. Therefore, it is possible to avoid a change in the refrigerant density (liquid refrigerant amount) in the liquid pipe due to the outdoor temperature. Therefore, as in FIG. 4, since the decrease in the total refrigerant amount results in the decrease in the refrigerant amount of the condenser, it is possible to improve the detection accuracy of the refrigerant amount using $A_L$% and $A_G$%.

Figure 6:
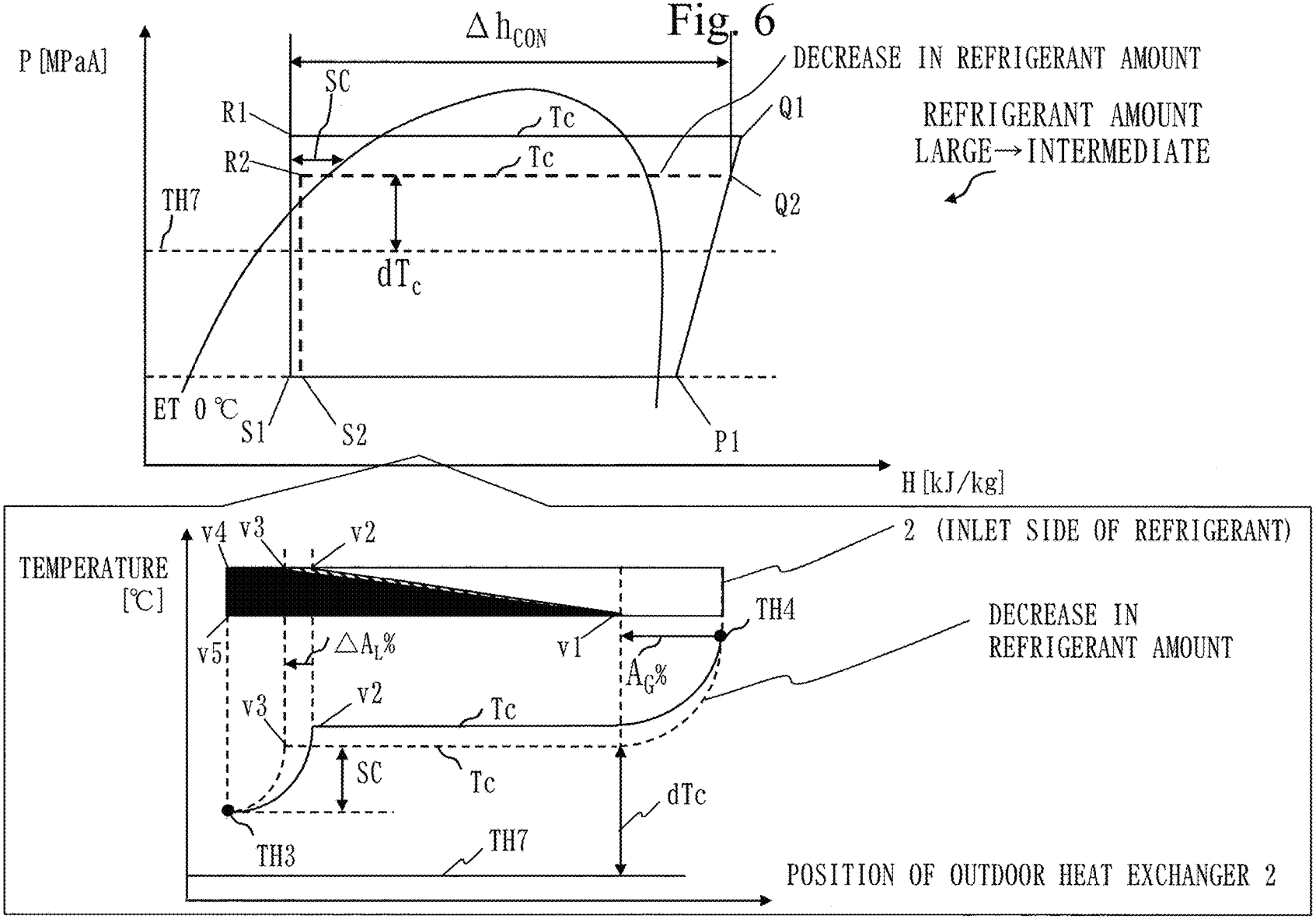
FIG. 6 is a diagram of Embodiment 1 and is a diagram illustrating a case where a refrigerant amount transitions from a large amount state to an intermediate amount state.

A state of the outdoor heat exchanger 2 which is the condenser is divided into a gas phase, a two-phase, and a liquid phase. When SC>0 and there is the liquid phase at the outlet of the condenser, $A_G$% does not change much even if the refrigerant amount decreases. Therefore, when SC>0, the refrigerant amount is detected using $A_L$%. This is illustrated in FIG. 6 to be described below. A reason why $A_G$% does not change much is that the denominator and the numerator in the parentheses of Ln( ) in (Formula 2) change to the same extent due to a high-pressure change.

Further, when the refrigerant amount decreases and SC=0, there is no liquid phase. Therefore, the refrigerant amount is detected using $A_G$%. When SC=0, the refrigerant amount cannot be detected using $A_L$%. A reason of this is that when SC=0, the inside of the parentheses of Ln( ) in (Formula 1) is 0, so that $A_L$% is 0.

Since the outlet of the condenser is in the two-phase, the opening of the LEV is insufficient, and the gas phase expands (the discharge $SH_d$ increases) as the suction SHs increases. Therefore, as illustrated in FIG. 7 to be described below, the refrigerant amount can be detected using $A_G$%.

Refrigerant amount detection using $A_L$% of step S50 and refrigerant amount detection using $A_G$% of step S40 will be described with reference to FIGS. 6 and 7.

FIG. 6 illustrates a case where the refrigerant amount transitions from a large amount state to an intermediate amount state.

Figure 7:
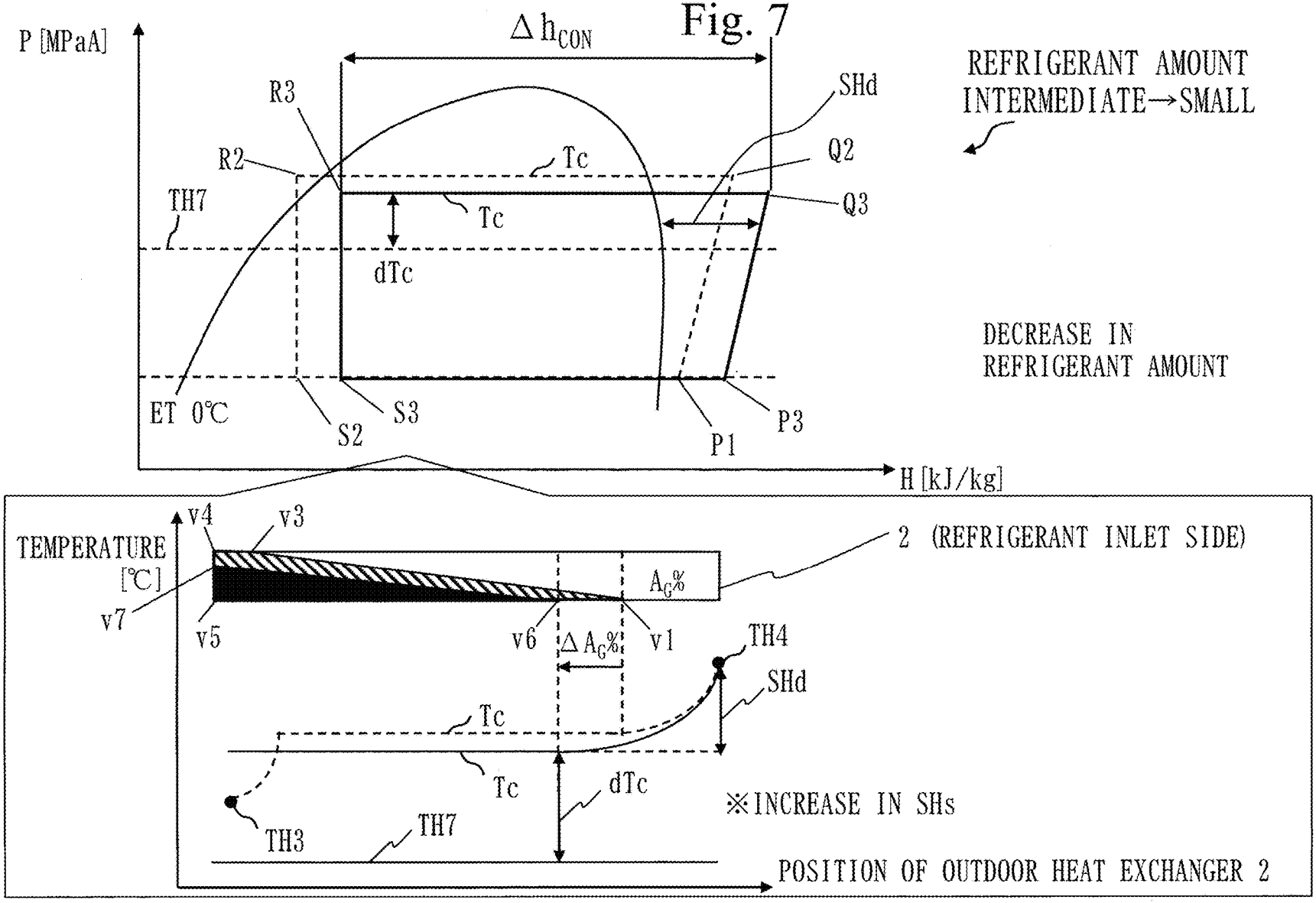
FIG. 7 is a diagram of Embodiment 1 and is a diagram illustrating a case where the refrigerant amount transitions from the intermediate amount state to a small amount state.

FIG. 7 illustrates a case where the refrigerant amount transitions from the intermediate state to a small amount state.

The upper side of FIG. 6 is a PH diagram, and the lower side of FIG. 6 illustrates a relation between a position of the outdoor heat exchanger 2 with respect to the PH diagram and a temperature of the refrigerant. In the diagram on the lower side of FIG. 6, the horizontal axis indicates the position of the outdoor heat exchanger 2, and the vertical axis indicates the temperature of the refrigerant. FIG. 7 is also the same.

FIG. 6 will be described. The PH diagram illustrates a refrigeration cycle with a large refrigerant amount and a refrigeration cycle with the refrigerant amount which has decreased and is about an intermediate level. The refrigeration cycle with the large refrigerant amount is the solid line of P1, Q1, R1, and S1. The refrigeration cycle with the intermediate level of the refrigerant amount is the dashed line of P1, Q2, R2, and S2. The PH diagram indicates $\Delta h_{con}$ and $dT_c$. In FIG. 6, the inlet side of the refrigerant of the outdoor heat exchanger 2 is on the right side, and the outlet side of the refrigerant of the outdoor heat exchanger 2 is on the left side. The refrigeration cycle of P1, Q1, R1, and S1 correlates with the liquid phase refrigerant having the shape of v1, v2, v4, v5, and v1. With respect to the temperature, the temperature increases since v4 to v2 is in the liquid phase, and the temperature is constant since v2 to v1 is in the two-phase. This temperature is $T_c$ of the refrigeration cycle of P1, Q1, R1, and S1. The temperature rises toward TH4 since the right side of v1 is in the gas phase.

The refrigeration cycle of P1, Q2, R2, and S2 correlates with the liquid phase refrigerant having the shape of v1, v3, v4, v5, and v1.

In the shape of v1, v3, v4, v5, and v1, the liquid phase is decreased by $\Delta A_L$% with respect to the shape of v1, v2, v4, v5, and v1.

$A_G$% hardly changes in the refrigeration cycle of P1, Q2, R2, and S2.

With respect to the temperature, the temperature increases since v4 to v3 is in the liquid phase, and the temperature is constant since v3 to v1 is in the two-phase. This temperature is $T_c$ of the refrigeration cycle of P1, Q2, R2, and S2.

The temperature rises toward TH4 since the right side of v1 is in the gas phase.

In the refrigeration cycle of P1, Q2, R2, and S2, FIG. 6 indicates the subcooling degree SC and $dT_c$.

FIG. 7 will be described. The PH diagram illustrates the refrigeration cycle with the intermediate level of the refrigerant amount and a refrigeration cycle with the refrigerant amount which has decreased and is small. The refrigeration cycle with the intermediate level of the refrigerant amount is P1, Q2, R2, and S2 described in FIG. 6. The refrigeration cycle with the small refrigerant amount is the solid line of P3, Q3, R3, and S3. The PH diagram indicates $\Delta h_{con}$ and $dT_c$ for the refrigeration cycle of P3, Q3, R3, and S3. The refrigeration cycle of P1, Q2, R2, and S2 correlates with the liquid phase refrigerant having the shape of v1, v3, v4, v5, and v1. The temperature is as described in FIG. 6.

The refrigeration cycle of P3, Q3, R3, and S3 correlates with the liquid phase refrigerant having the shape of v6, v7, v5, and v6. In the shape of v6, v7, v5, and v5, the gas phase is increased by $\Delta A_G$% with respect to the shape of v1, v3, v4, v5, and v1. The temperature is constant since v7 to v6 is in the two-phase. This temperature is the condensation temperature $T_c$ of the refrigeration cycle of P3, Q3, R3, and S3. The temperature rises toward TH4 since the right side of v6 is in the gas phase. The temperature rises toward TH4 since the right side of v1 is in the gas phase. The refrigeration cycle of P3, Q3, R3, and S3 indicates a superheat degree $SH_d$ in FIG. 7.

Effects of Embodiment 1

Figure 8:
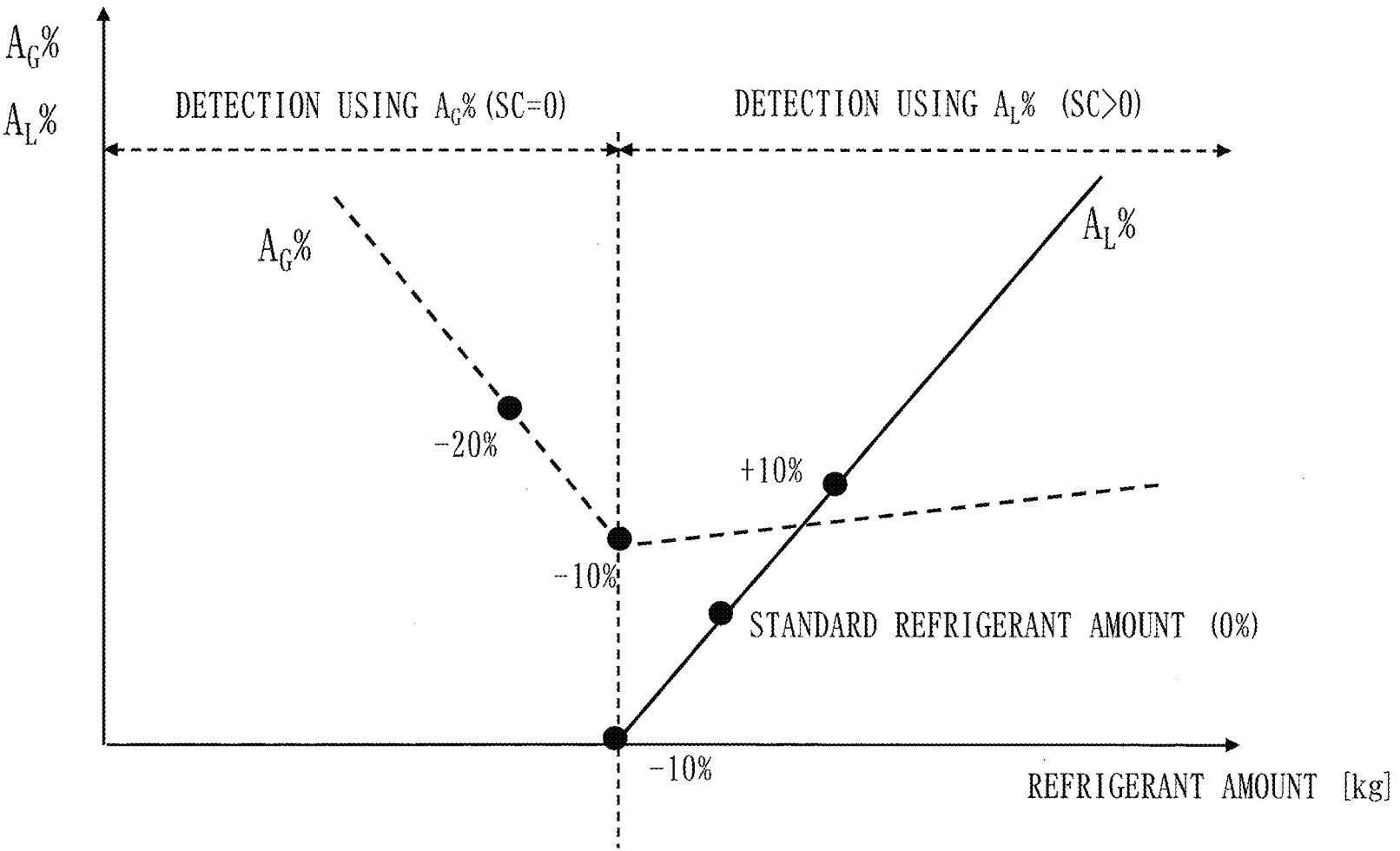
FIG. 8 is a diagram of Embodiment 1 and is a diagram illustrating that refrigerant amount detection is possible within a total refrigerant amount by using $A_L$% and $A_G$% together.

FIG. 8 illustrates that the refrigerant amount detection is possible within a range of the total refrigerant amount, by using $A_L$% and $A_G$% together. When the refrigerant leakage amount is detected using only $A_L$%, the leakage amount of the refrigerant has been only known up to about 10% of the standard refrigerant amount, as illustrated in FIG. 8. This is because when the leakage amount of the refrigerant exceeds 10% of the standard refrigerant amount, the refrigerant at the outlet of the condenser is in the two-phase state due to the decrease in the refrigerant amount, as illustrated in FIG. 7. When the refrigerant at the outlet of the condenser is in the two-phase state, the subcooling degree is SC=0 and the refrigerant amount could not have been conventionally estimated.

On the other hand, since the refrigerant detection apparatus 100 also uses $A_G$%, the refrigerant amount can be detected even when the leakage amount of the refrigerant exceeds 10% of the standard refrigerant amount, as illustrated in FIG. 8. Therefore, since it is sufficient to fill only an additional refrigerant amount without collecting all of the refrigerant, a maintenance work time can be shortened. Further, a cost of the refrigerant to be filled and a work cost of the filling refrigerant can be reduced.

In order to eliminate an effect due to a difference between operational states of the refrigeration cycle apparatus 50 at times of detection using $A_L$% and $A_G$%, it is preferable to fix the frequency of the compressor 1. However, since a rotational speed of the outdoor fan 2A of the outdoor heat exchanger 2 is fixed, reliability of the refrigeration cycle apparatus 50 may be highly degraded. Therefore, the frequency of the compressor 1 is not fixed. Thereby, the reliability of the refrigeration cycle apparatus 50 can be maintained.

A $dT_c$ ratio with respect to the refrigerant circulation amount ratio $G_{r_ratio}$ is corrected by using $[dT_{c_corr}]^{-1}$. By this correction, a standard state of the compressor 1 before the frequency changes is estimated, and an effect on the frequency change of the compressor 1 is excluded from the refrigerant amount detection. Therefore, the refrigerant amount detection with high accuracy is possible. According to the refrigerant amount detection with the high accuracy, a performance of the refrigeration cycle apparatus 50 can be maintained.

<Supplement of Hardware Configuration>

A hardware configuration of the refrigerant detection apparatus 100 will be supplemented below.

Figure 9:
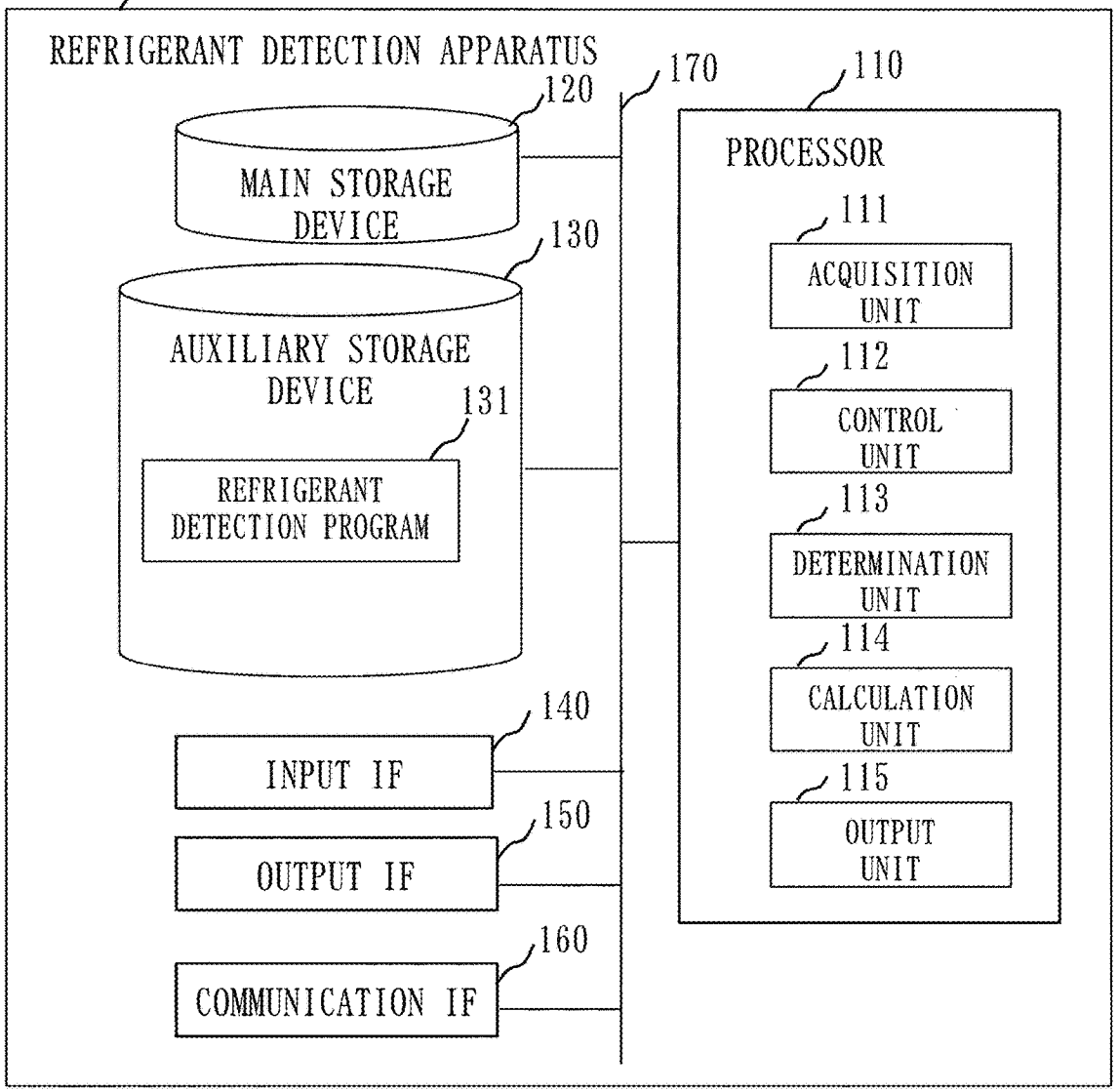
FIG. 9 is a diagram of Embodiment 1 and is a diagram illustrating a hardware configuration of the refrigerant detection apparatus 100.

FIG. 9 illustrates the hardware configuration of the refrigerant detection apparatus 100. The hardware configuration of the refrigerant detection apparatus 100 will be described with reference to FIG. 9.

The refrigerant detection apparatus 100 is a computer. The refrigerant detection apparatus 100 includes a processor 110. The refrigerant detection apparatus 100 includes a plurality of pieces of hardware in addition to the processor 110. The plurality of pieces of hardware are a main storage device 120, the auxiliary storage device 130, an input IF 140, an output IF 150, and a communication IF 160. IF stands for interface. The processor 110 is connected to other pieces of hardware via a signal line 170 and controls the other pieces of hardware.

The refrigerant detection apparatus 100 includes the acquisition unit 111, the control unit 112, the determination unit 113, the calculation unit 114, and the output unit 115, as functional elements. Functions of the acquisition unit 111, the control unit 112, the determination unit 113, the calculation unit 114, and the output unit 115 are implemented by a refrigerant detection program 131 that detects the leakage amount of the refrigerant.

The processor 110 is a device that executes the refrigerant detection program 131. The processor 110 executes the refrigerant detection program 131 to implement the functions of the acquisition unit 111, the control unit 112, the determination unit 113, the calculation unit 114, and the output unit 115. The processor 110 is an Integrated Circuit (IC) that performs computation processing. Specific examples of the processor 110 are a Central Processing Unit (CPU), a Digital Signal Processor (DSP), and a Graphics Processing Unit (GPU).

The main storage device 120 is a storage device. Specific examples of the main storage device 120 are a Static Random Access Memory (SRAM) and a Dynamic Random Access Memory (DRAM). The main storage device 120 holds a computation result of the processor 110.

The auxiliary storage device 130 is a storage device that keeps data in a nonvolatile manner. A specific example of the auxiliary storage device 130 is a Hard Disk Drive (HDD). Further, the auxiliary storage device 130 may be a portable recording medium. Examples of the portable recording medium include a Secure Digital (SD: registered trademark) memory card, a NAND flash, a flexible disk, an optical disk, a compact disk, a Blu-ray (registered trademark) disk, and a Digital Versatile Disk (DVD). The auxiliary storage device 130 stores the refrigerant detection program 131.

The input IF 140 is a port to which data is input from the individual devices and the individual sensors. The output IF 150 is connected to various types of devices. The output IF 150 is a port through which data is output by the processor 110 to the various types of devices such as a display device, an audio device, and an external storage device. The communication IF 160 is a communication port through which the processor communicates with the other devices.

The processor 110 loads the refrigerant detection program 131 from the auxiliary storage device 130 to the main storage device 120. The processor 110 reads the loaded refrigerant detection program 131 from the main storage device 120 and executes the refrigerant detection program 131. The main storage device 120 also stores an Operating System (OS) in addition to the refrigerant detection program 131. The processor 110 executes the refrigerant detection program 131 while executing the OS. The refrigerant detection apparatus 100 may include a plurality of processors that substitute for the processor 110. The plurality of processors execute the refrigerant detection program 131 by sharing. Each of the processors is a device that executes the refrigerant detection program 131 in the same way as the processor 110. Data, information, a signal value, and a variable value which are utilized, processed, or output by the refrigerant detection program 131 are stored in the main storage device 120, the auxiliary storage device 130, or a register or a cache memory in the processor 110.

The refrigerant detection program 131 is a program that causes the computer to execute processes, procedures, or stages corresponding to the acquisition unit 111, the control unit 112, the determination unit 113, the calculation unit 114, and the output unit 115, each with its "unit" being replaced by "process", "procedure", or "stage".

Further, a refrigerant detection method is a method that is performed by the refrigerant detection apparatus 100 which is the computer, as the refrigerant detection apparatus 100 executes the refrigerant detection program 131. The refrigerant detection program 131 may be provided as being stored in a computer readable recording medium or may be provided as a program product.

In the refrigerant detection apparatus 100 of FIG. 9, a function of the refrigerant detection apparatus 100 is implemented by software. However, the function of the refrigerant detection apparatus 100 may be implemented by hardware.

Figure 10:
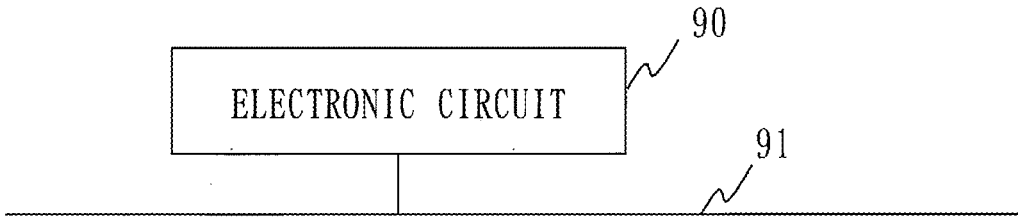
FIG. 10 is a diagram of Embodiment 1 and is a diagram illustrating another hardware configuration of the refrigerant detection apparatus 100.

FIG. 10 illustrates a configuration in which the function of the refrigerant detection apparatus 100 is implemented by hardware. An electronic circuit 90 of FIG. 10 is a dedicated electronic circuit that implements the functions of the acquisition unit 111, the control unit 112, the determination unit 113, the calculation unit 114, and the output unit 115, of the refrigerant detection apparatus 100. The electronic circuit 90 is connected to a signal line 91. The electronic circuit 90 is specifically a single circuit, a composite circuit, a programmed processor, a parallel-programmed processor, a logic IC, a GA, an ASIC, or an FPGA. GA stands for Gate Array. ASIC stands for Application Specific Integrated Circuit. FPGA stands for Field-Programmable Gate Array. The functions of the constituent elements of the refrigerant detection apparatus 100 may be implemented by one electronic circuit, or may be implemented by a plurality of electronic circuits by sharing. Alternatively, some of the functions of the constituent elements of the refrigerant detection apparatus 100 may be implemented by an electronic circuit, and the remaining functions may be implemented by software.

Each of the processor 110 and the electronic circuit 90 is referred to as processing circuitry or circuitry. In the refrigerant detection apparatus 100, the functions of the acquisition unit 111, the control unit 112, the determination unit 113, the calculation unit 114, and the output unit 115 may be implemented by circuitry.

Embodiment 2

A refrigerant amount determination system 200 of Embodiment 2 will be described with reference to FIGS. 11 to 20. The refrigerant amount determination system 200 is also a communication system in which a cloud server 100CS communicates with an air conditioning side control device 400 and the cloud server 100CS communicates with a terminal device 500. In Embodiment 2, the refrigerant detection apparatus 100 of Embodiment 1 is implemented as the cloud server 100CS. In Embodiment 2, a feature is that the cloud server 100CS remotely determines the refrigerant amount in the refrigeration cycle apparatus 50.

<Refrigerant Amount Determination System 200>

Figure 11:
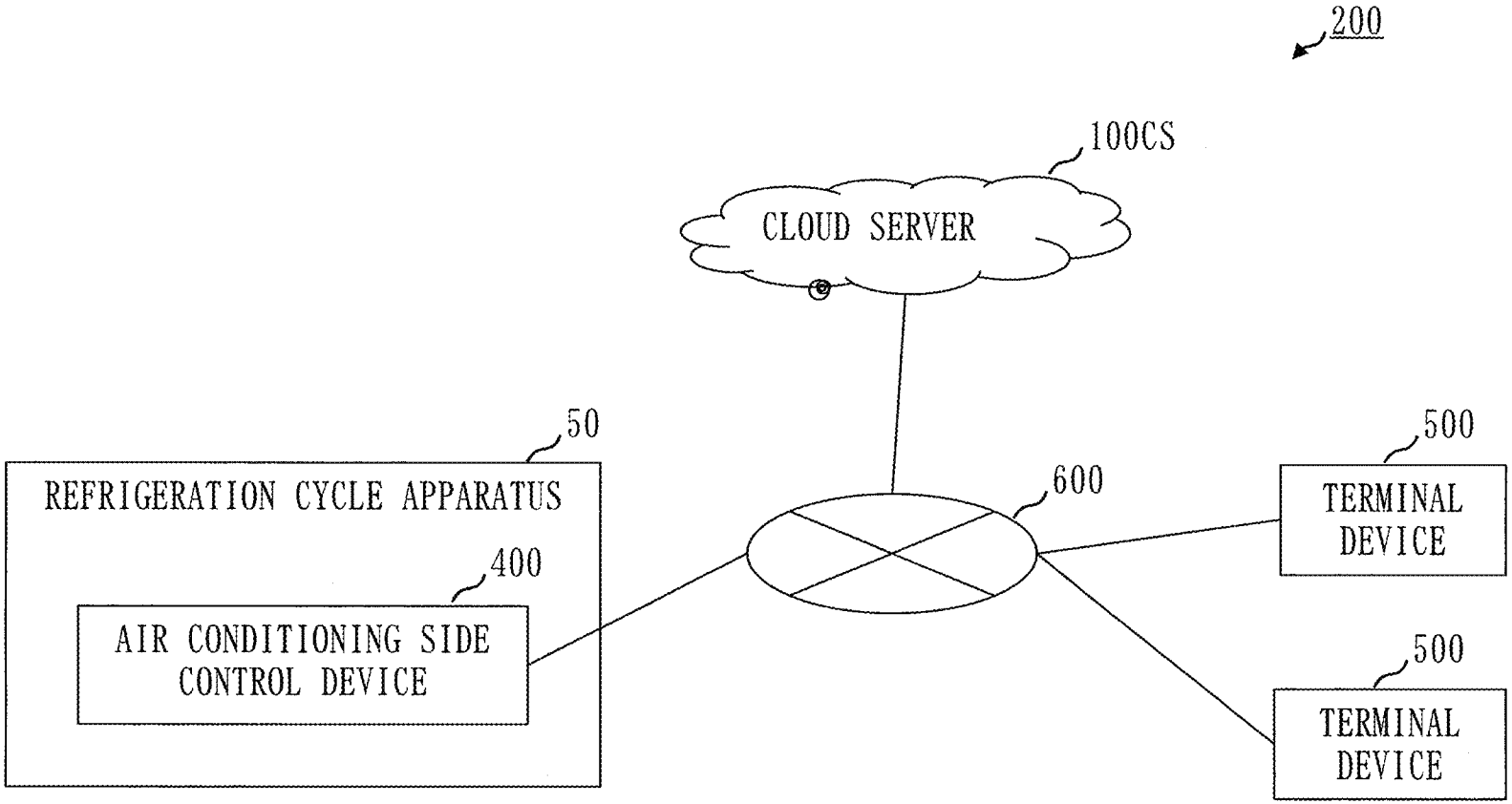
FIG. 11 is a diagram of Embodiment 2 and is a diagram illustrating a system configuration of a refrigerant amount determination system 200.

FIG. 11 illustrates a system configuration of the refrigerant amount determination system 200 according to Embodiment 2. The refrigerant amount determination system 200 includes the cloud server 100CS, the air conditioning side control device 400, and the terminal device 500.

The air conditioning side control device 400 is a refrigeration cycle side control device. The cloud server 100CS is a server device. The refrigerant amount determination system 200 may include a plurality of terminal devices 500. Although there will be a terminal device 500A and a terminal device 500B below, both are the terminal device 500. The air conditioning side control device 400 is disposed in the refrigeration cycle apparatus 50. The air conditioning side control device 400 may be disposed in the outdoor unit 20. The cloud server 100CS, the air conditioning side control device 400, and the terminal device 500 are connected to a network 600. The cloud server 100CS, the air conditioning side control device 400, and the terminal device 500 can communicate with each other via the network 600. The network 600 can also replace a public network.

<Cloud Server 100CS>

Figure 12:
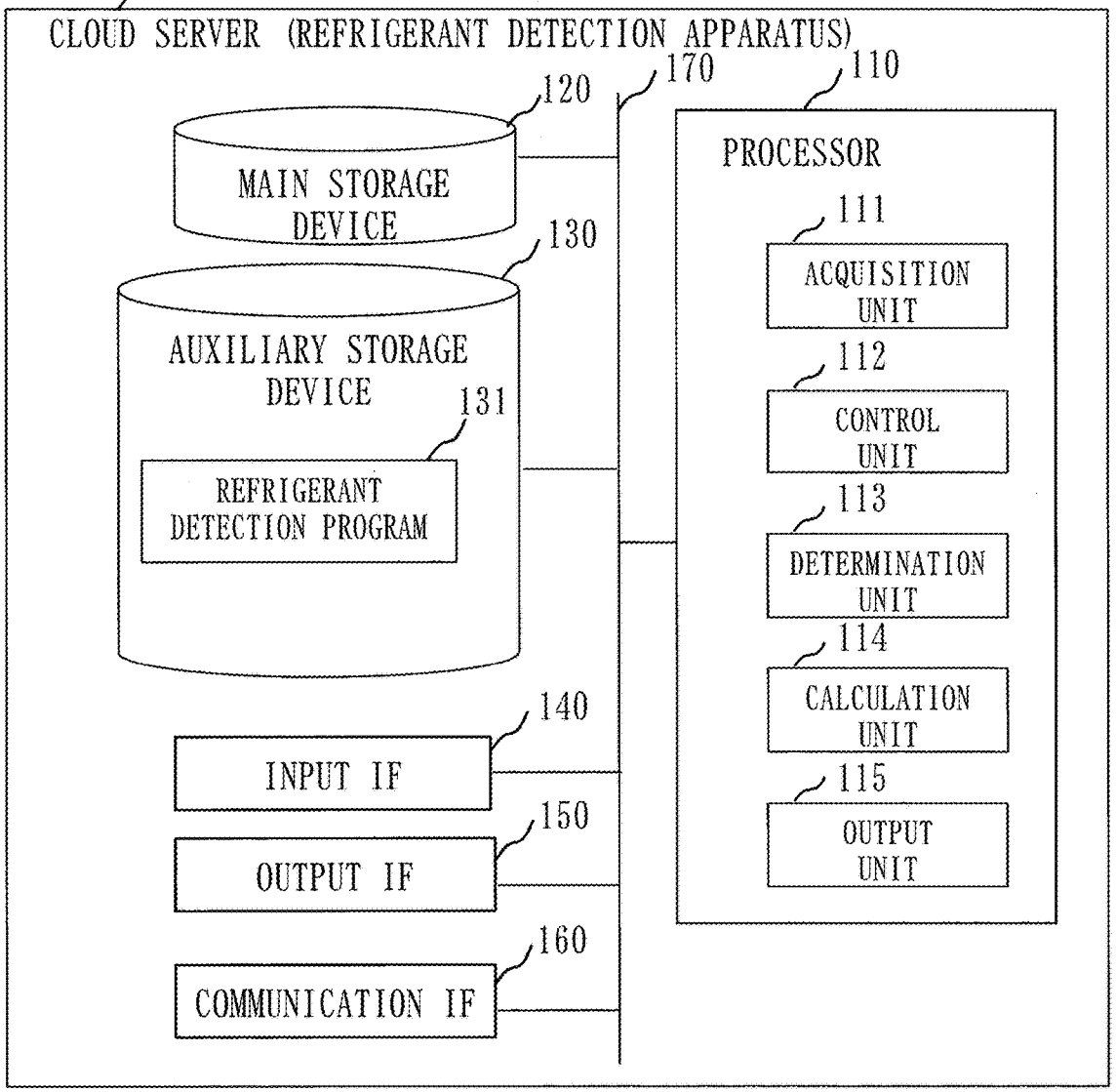
FIG. 12 is a diagram of Embodiment 2 and is a hardware configuration diagram of a cloud server 100CS that implements the refrigerant detection apparatus 100.

FIG. 12 illustrates a hardware configuration of the cloud server 100CS that implements the refrigerant detection apparatus 100. Since the configuration of FIG. 12 is the same as that of FIG. 9, description thereof is omitted.

<Air Conditioning Side Control Device 400>

Figure 13:
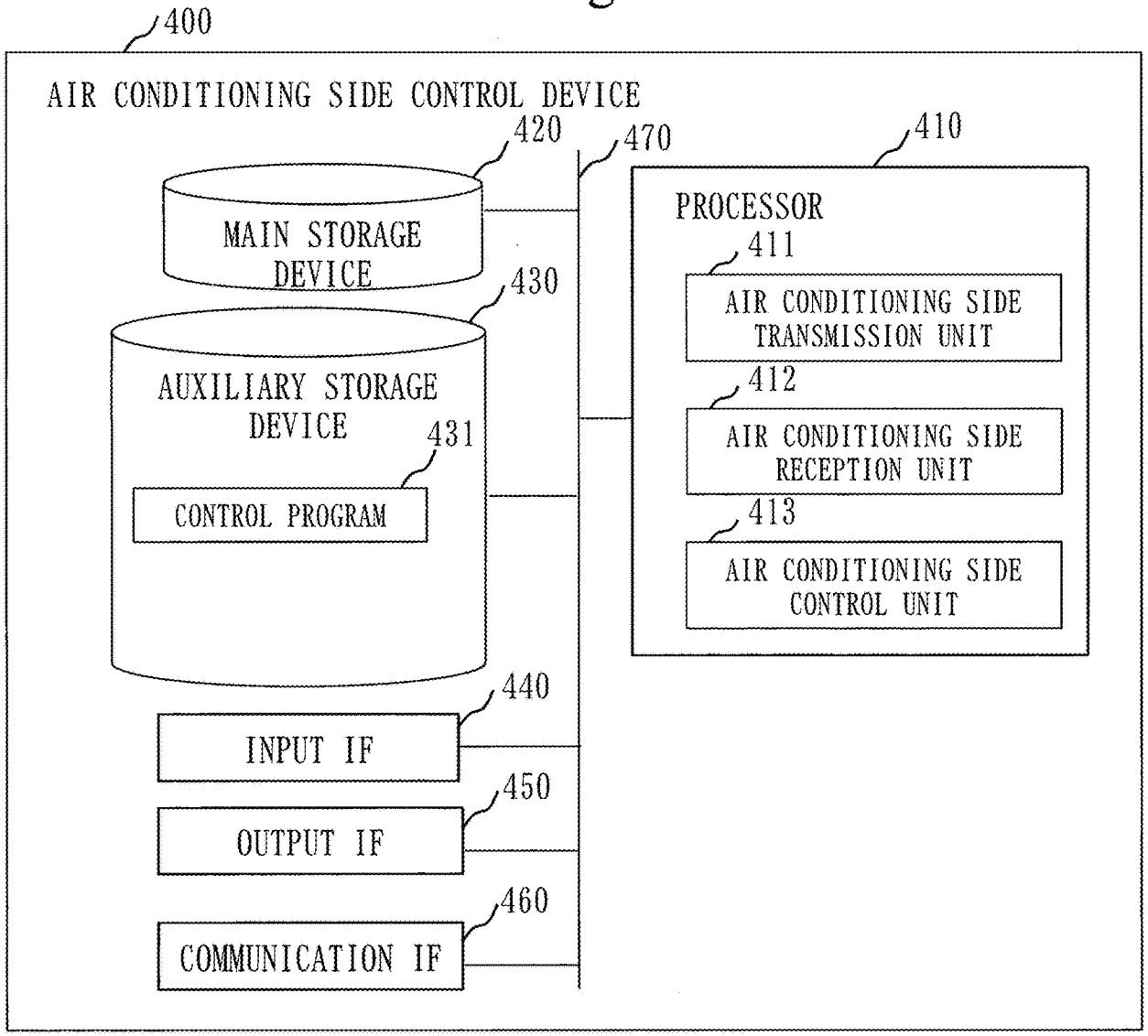
FIG. 13 is a diagram of Embodiment 2 and is a hardware configuration diagram of an air conditioning side control device 400.

FIG. 13 is a hardware configuration of the air conditioning side control device 400. The air conditioning side control device 400 is a computer similar to the refrigerant detection apparatus 100 of FIG. 9. The air conditioning side control device 400 includes an air conditioning side transmission unit 411, an air conditioning side reception unit 412, and an air conditioning side control unit 413, as functional elements. The air conditioning side transmission unit 411 transmits information using a communication IF 460. The air conditioning side reception unit 412 receives information using the communication IF 460. The air conditioning side control unit 413 executes control processing other than transmission and reception.

<Terminal Device 500>

Figure 14:
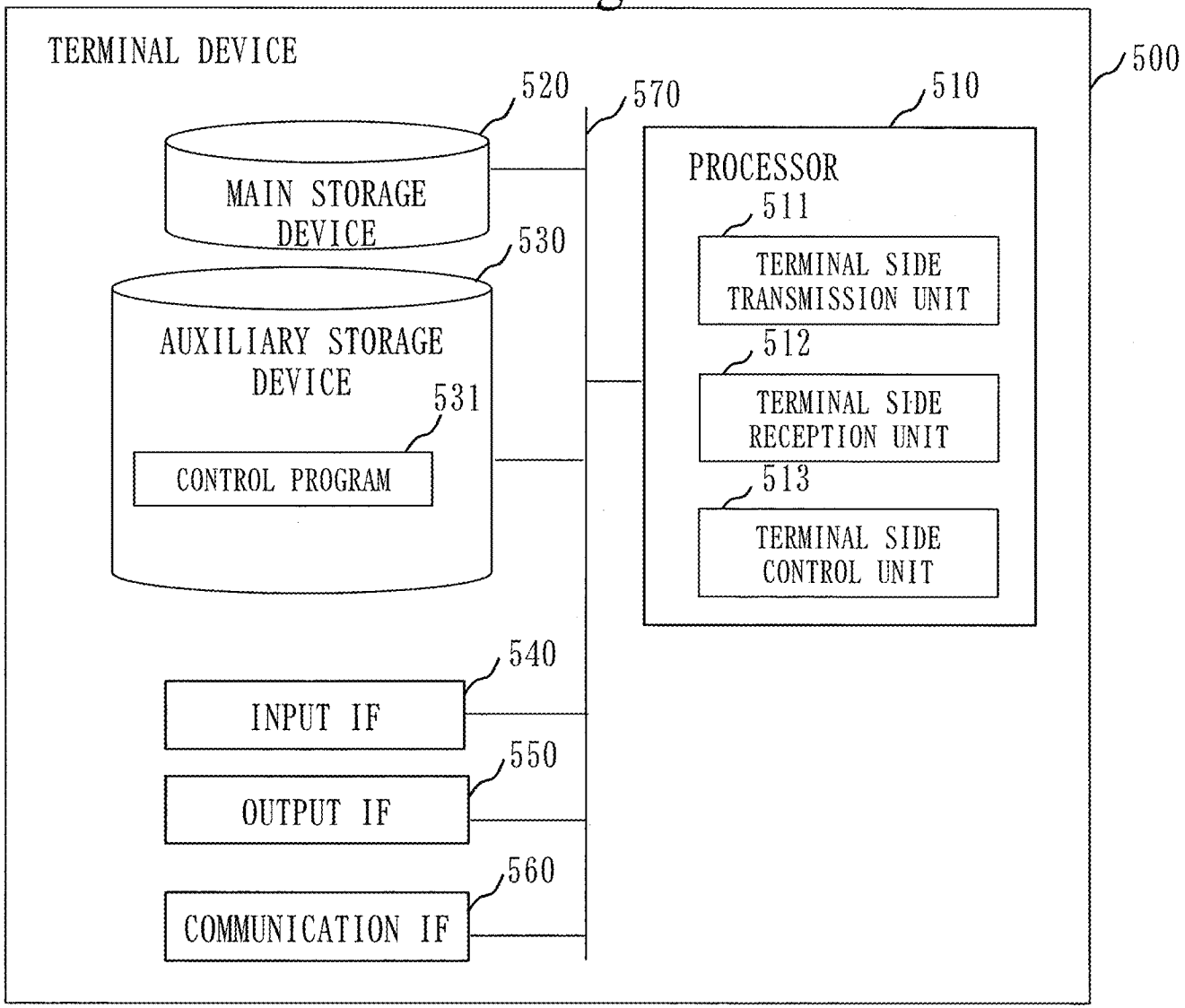
FIG. 14 is a diagram of Embodiment 2 and is a hardware configuration diagram of a terminal device 500.

FIG. 14 is a hardware configuration of the terminal device 500. The terminal device 500 is also a computer. The terminal device 500 includes a terminal side transmission unit 511, a terminal side reception unit 512, and a terminal side control unit 513, as functional elements. The terminal side transmission unit 511 transmits information using a communication IF 560. The terminal side reception unit 512 receives information using the communication IF 560. The terminal side control unit 513 executes control processing other than transmission and reception.

It is important for stable operation of the refrigeration cycle apparatus 50, to enclose the refrigerant circuit 51 of the refrigeration cycle apparatus 50 with an appropriate refrigerant amount. A mechanism of confirmation of a refrigerant enclosing amount during construction of the refrigeration cycle apparatus 50 and a mechanism of monitoring a refrigerant leakage during normal operation of the refrigeration cycle apparatus 50 are implemented.

Conventionally, when constructing the refrigeration cycle apparatus 50, a maintenance company or a sales agent of the refrigeration cycle apparatus 50 performs the test operation of the refrigeration cycle apparatus 50, and confirms whether or not the refrigerant enclosing amount in the refrigeration cycle apparatus 50 is appropriate. General confirmation items include temperature or pressure of parts such as the following (1) to (6). Conventionally, a maintenance worker measures the confirmation items of (1) to (6), and determines whether or not the refrigerant enclosing amount is appropriate.

(1) Blow out temperature of the indoor unit 30,
(2) Discharge temperature of the compressor 1,
(3) Pressure of the compressor 1 on the suction side,
(4) Suction superheat,
(5) Discharge superheat,
(6) Temperature of the compressor under a shell.

It is difficult for an inexperienced maintenance service person to perform such a method of determining whether or not the filling amount of the refrigerant is appropriate, by measuring (1) to (6). This is because the determination is required to be made after taking into account complex factors like a local condition such as a length of a pipe and an environmental condition such as the outdoor temperature TH7.

The refrigerant amount determination system 200 using the refrigerant detection apparatus 100 solves the problem that the determination of the filling amount of the refrigerant requires the experience of the maintenance worker and the determination of the refrigerant filling amount is difficult for the inexperienced maintenance worker 612. By solving this problem, it is possible to obtain effects such as achievement of an appropriate filling cost and reduction in a maintenance work cost.

Specific effects are as described in the following (1) to (4).

(1) Since the maintenance worker 612 can remotely determine the refrigerant filling amount from the worker's site without visiting a site to measure the refrigerant filling amount, this can contribute to labor saving for the maintenance company. Further, no special experience is required, and even a new worker can determine the refrigerant filling amount with manual operation of a computer.

(2) Since the computer calculates the filling amount with high accuracy, over filling of the refrigerant is prevented. Therefore, this contributes to optimization of a refrigerant cost.

(3) According to the refrigerant amount determination system 200, the determination of the refrigerant amount is possible at not only the test operation during construction but also an arbitrary timing during the normal operation after the construction. Therefore, accurate refrigerant leakage detection is possible during the normal operation. Since the accuracy of the refrigerant leakage is improved, this can contribute to conservation of the global environment. Further, this can comply with the Fluorocarbon Emission Control Law. The refrigerant amount determination system 200 can detect a slow leak by execution over time.

(4) When the refrigerant amount determination system 200 detects the refrigerant leakage during the normal operation, an evacuation warning can be issued to a building 610 in which the subject refrigeration cycle apparatus 50 is installed.

<Relation between Refrigerant Amount and $A_L$%, $A_G$%>

A refrigerant amount determination function in the refrigerant amount determination system 200 that implements the refrigerant detection apparatus 100 as the cloud server 100CS will be summarized. In the refrigerant amount detection mode, the refrigeration cycle apparatus 50 performs the cooling operation. The refrigerant amount detection mode is an operation mode (step S20 of FIG. 2) of the refrigeration cycle apparatus 50 for detecting the refrigerant amount. That is, the outdoor heat exchanger 2 functions as the condenser and the indoor heat exchanger 7 functions as the evaporator. At this time, the outdoor heat exchanger 2 is focused, and the cloud server 100CS determines the liquid phase ratio $A_L$% and the gas phase ratio $A_G$% of the refrigerant in the outdoor heat exchanger 2. When the appropriate refrigerant amount is enclosed in the refrigeration cycle apparatus 50, $A_L$% is around 17.5%. When the refrigerant is excessive with respect to the appropriate refrigerant amount, the liquid phase ratio $A_L$% increases. When the refrigerant is insufficient with respect to the appropriate refrigerant amount, the liquid phase ratio $A_L$% decreases. As described in Embodiment 1, when an insufficient amount of the refrigerant is large, it is effective to calculate the refrigerant amount using the gas phase ratio $A_G$%. When the insufficient amount of the refrigerant is large, the gas phase ratio $A_G$% increases.

As illustrated in FIG. 1, the refrigeration cycle apparatus 50 is connected to the compressor 1, the outdoor heat exchanger 2, the HIC 3, the HIC-LEV 4, the LEV 6, the indoor heat exchanger 7, the four-way valve 9, and the ACC 10 through refrigerant pipes, to form the refrigerant circuit 51. As described in Embodiment 1, at least ten types of sensors to be described below are disposed in the refrigerant circuit 51. In Embodiment 2, the detection values of these sensors are transmitted from the air conditioning side control device 400 to the cloud server 100CS. The detection values of the sensors transmitted are summarized in FIG. 15.

FIG. 15 illustrates the detection values of the sensors transmitted from the air conditioning side control device 400 to the cloud server 100CS. A detection value is transmitted as a parameter in a state in which it is known which sensor has transmitted the detection value. In FIG. 15, the first column from the left is a row number. The second column from the left is a type of a sensor. The third column from the left is a notation of the type of the sensor plus the row number. The fourth column from the left indicates a detection subject of the sensor. The fifth column from the left indicates a representative subject among subjects for which the detection values are used in (Formula 1) to (Formula 13) described in Embodiment 1. The cloud server 100CS can perform the control, the determination, and the calculation of steps S20 to S50 of FIG. 2, by acquiring the detection value of each of the sensors from the air conditioning side control device 400.

When calculating the refrigerant amount, the refrigerant amount determination system 200 executes the refrigerant amount detection mode illustrated in FIG. 2 in order to accurately calculate the refrigerant amount. The refrigerant amount detection mode by the refrigerant amount determination system 200 is illustrated in step S20 of FIG. 2.

Figure 16:
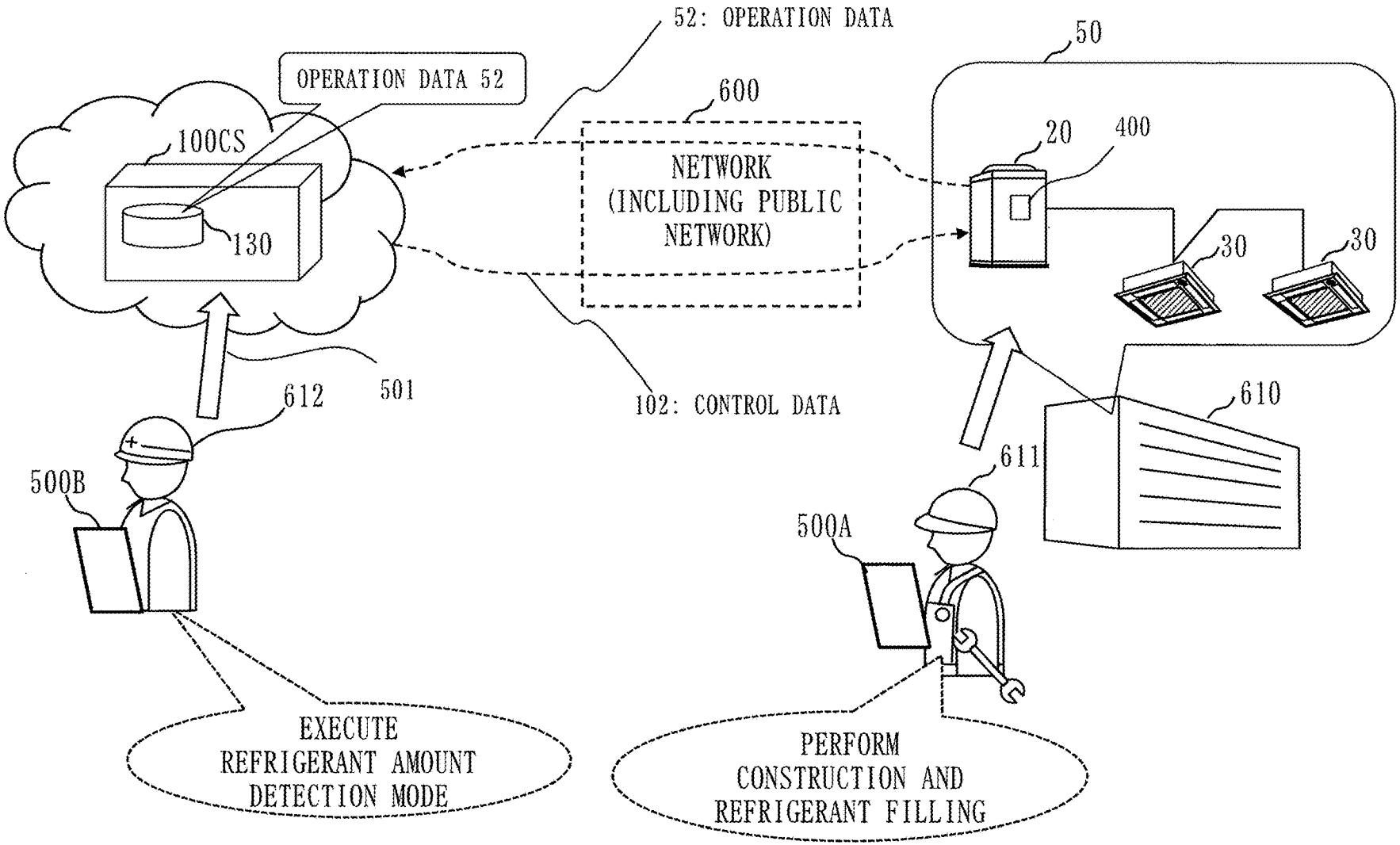
FIG. 16 is a diagram of Embodiment 2 and is a diagram illustrating an outline at a time when the refrigeration cycle apparatus 50 is test operated.

FIG. 16 illustrates an outline at a time when the refrigeration cycle apparatus 50 is test operated.

Figure 17:
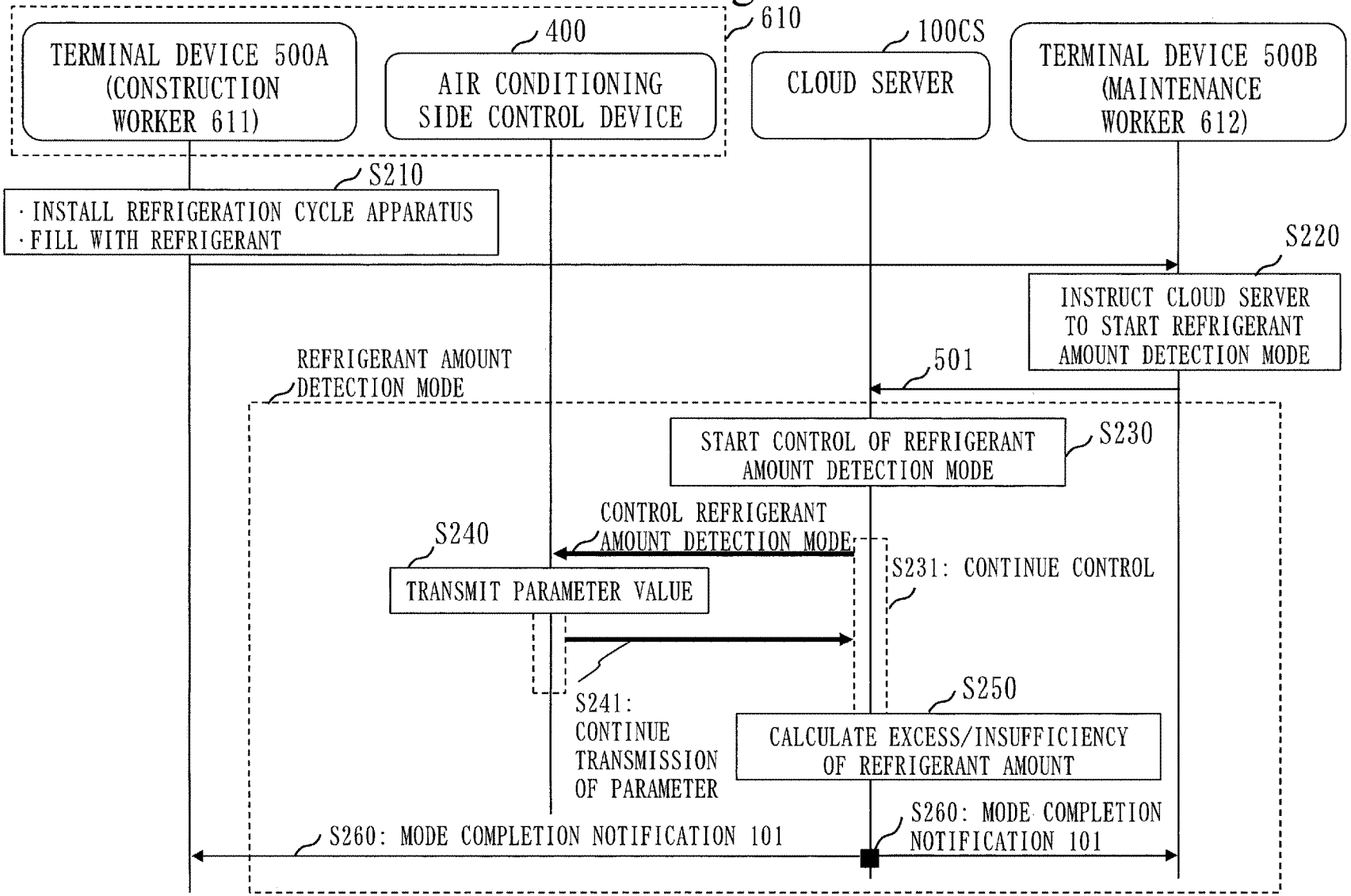
FIG. 17 is a diagram of Embodiment 2 and is a sequence diagram of the test operation of the refrigeration cycle apparatus 50.

FIG. 17 is a sequence diagram of the test operation of the refrigeration cycle apparatus 50. As a premises for the test operation, a construction worker 611 installs the refrigeration cycle apparatus 50 in the building 610. When the refrigeration cycle apparatus 50 is installed in the building 610, the refrigeration cycle apparatus 50 is filled with the refrigerant and the test operation of the refrigeration cycle apparatus 50 is performed. During the test operation of the refrigeration cycle apparatus 50, the excess or insufficiency of the refrigerant amount is determined by the cloud server 100CS. The test operation of the refrigeration cycle apparatus 50 will be described with reference to FIGS. 16 and 17.

<Step S210>

In step S210, the construction worker 611 installs the refrigeration cycle apparatus 50 in the building 610. The construction worker 611 fills the installed refrigeration cycle apparatus 50 with the refrigerant. The construction worker 611 fills the refrigerant amount indicating a specification value of the refrigeration cycle apparatus 50, as the refrigerant filling amount at the installation. The construction worker 611 transmits the completion of the refrigerant filling to the terminal device 500B carried by the maintenance worker 612, using the terminal device 500A carried by the construction worker 611. The construction worker 611 may transmit the completion of the refrigerant filling from the terminal device 500A to the cloud server 100CS, and the cloud server 100CS may transmit the completion of the refrigerant filling to the terminal device 500B.

<Step S220>

The maintenance worker 612 receives the completion of the refrigerant filling from the construction worker 611. The following processes are performed by the maintenance worker 612 operating the terminal device 500B. The maintenance worker 612 starts the refrigerant amount detection mode at an arbitrary timing with consent of a user. In this example, the start of the refrigerant amount detection mode is performed by the maintenance worker 612. However, a person who performs the start of the refrigerant amount detection mode is not limited. Since the cooling operation is performed when the refrigerant amount detection mode is executed, the person who performs the starts the refrigerant amount detection mode is a person who can determine the execution of the operation of the refrigeration cycle apparatus 50. In step S220, the terminal side transmission unit 511 of the terminal device 500B transmits to the cloud server 100CS, a start command 501 that instructs the cloud server 100CS of the start of the refrigerant amount detection mode, via the communication IF 560 and the network 600. The start command 501 is a request signal that requests detection of the refrigerant amount present in the refrigerant circuit 51.

<Step S230>

The acquisition unit 111 of the cloud server 100CS acquires the start command 501 via the network 600 and the communication IF 160. When the acquisition unit 111 acquires the start command 501, the cloud server 100CS starts the refrigerant amount detection mode in step S230. Specifically, the processes illustrated in FIG. 2 are performed. As illustrated in FIG. 2, the control unit 112 controls the refrigeration cycle apparatus 50 to implement the operation in the refrigerant amount detection mode of (1) to (5) described in step S20. The control unit 112 continues the control of the refrigerant amount detection mode (step S231). That is, as illustrated in FIG. 2, the control unit 112 controls the refrigeration cycle apparatus 50 in the refrigerant amount detection mode in order to confirm the liquid phase ratio $A_L$% or the gas phase ratio $A_G$% of the outdoor heat exchanger 2 that functions as the condenser. The control of the refrigeration cycle apparatus 50 in the refrigerant amount detection mode means that the control unit 112 controls the actuators of the refrigeration cycle apparatus 50, such as the compressor 1, the fan 2A, the HIC-LEV 4, the LEV 6, and the indoor fan 7A so that the operational states of (1) to (5) of step S20 of FIG. 2 are implemented. More specifically, the control unit 112 of the cloud server 100CS transmits control data of each of the actuators to the air conditioning side control device 400, via the network 600. The air conditioning side reception unit 412 of the air conditioning side control device 400 receives the control date of each of the actuators via the network 600 and the communication IF 460. The air conditioning side control unit 413 controls each of the actuators using the control data of each of the actuators, received by the air conditioning side reception unit 412.

<Step S240>

When the control data of each of the actuators is received, the air conditioning side control unit 413 continuously transmits to the cloud server 100CS, the detection value of each of the sensors of the refrigeration cycle apparatus 50, in the air conditioning side control device 400. A detection value of a sensor is transmitted in a format in which the type of the sensor and the detection value are known. In a case of the discharge pressure HS of the compressor 1, it is transmitted as HS=, for example.  is a specific detection value. As illustrated in step S231, the refrigeration cycle apparatus 50 continuously receives the control, and the detection value of each of the sensors disposed in the refrigeration cycle apparatus 50 is continuously transmitted from the air conditioning side control device 400 to the cloud server 100CS while the refrigeration cycle apparatus 50 is continuously being controlled. Specifically, the air conditioning side transmission unit 411 continuously transmits to the cloud server 100CS, the detection value of each of the sensors, via the communication IF 460 and the network 600 (step S241). FIG. 15 illustrates the detection value of each of the sensors. The detection value of each of the sensors is transmitted from the air conditioning side control device 400 to the cloud server 100CS. As in FIG. 15, there are ten types of detection values, which are No. 1 to No. 10, for each of the sensors. The cloud server 100CS can perform the determination of step S30 of FIG. 2 and the calculation of steps S40 and S50, by using the detection value of each of the sensors transmitted from the air conditioning side control device 400.

<Step S250>

The cloud server 100CS calculates excess or insufficiency of the refrigerant amount, using the detection value of each of the sensors. Contents of the process of step S250 are the processes of steps S30 to S50 of FIG. 2. Step S60 is performed as the process of step S260 to be described below. In step S250, the calculation unit 114 calculates the refrigerant amount currently present in the refrigerant circuit 51, using $A_L$% or $A_G$%, by the processes of steps S40 and S50. Then, the calculation unit 114 calculates the excess or insufficiency of the refrigerant amount, from a difference between the calculated current refrigerant amount and the standard refrigerant amount that needs to be in the refrigerant circuit 51. The output unit 115 stores in the auxiliary storage device 130, the refrigerant amount and the excess or insufficiency amount calculated by the calculation unit 114, and the detection value of each of the sensors used for the calculation by the calculation unit 114, as operation data.

<Step S260>

In step S260, the output unit 115 of the cloud server 100CS transmits to the terminal device 500A and the terminal device 500B, a mode completion notification 101 notifying that the refrigerant amount detection mode has completed, via the communication IF 160 and the network 600. The terminal side reception unit 512 receives the mode completion notification 101 via the communication IF 560. The terminal device 500 can access the cloud server 100CS and refer to the operation data. Specifically, the terminal side transmission unit 511 transmits the operation data request signal to the cloud server 100CS. In the cloud server 100CS, the acquisition unit 111 acquires the operation data request signal. When the operation data request signal is acquired, the output unit 115 transmits the operation data to the terminal device 500. The operation data incudes at least the excess or insufficiency amount of the refrigerant. In the terminal device 500, the terminal side reception unit 512 receives the operation data, and the terminal side control unit 513 displays the operation data on a display device which is not illustrated. The mode completion notification 101 may include a result of the excess or insufficiency of the refrigerant.

<Refrigerant Amount Detection Mode During Normal Operation>

Figure 18:
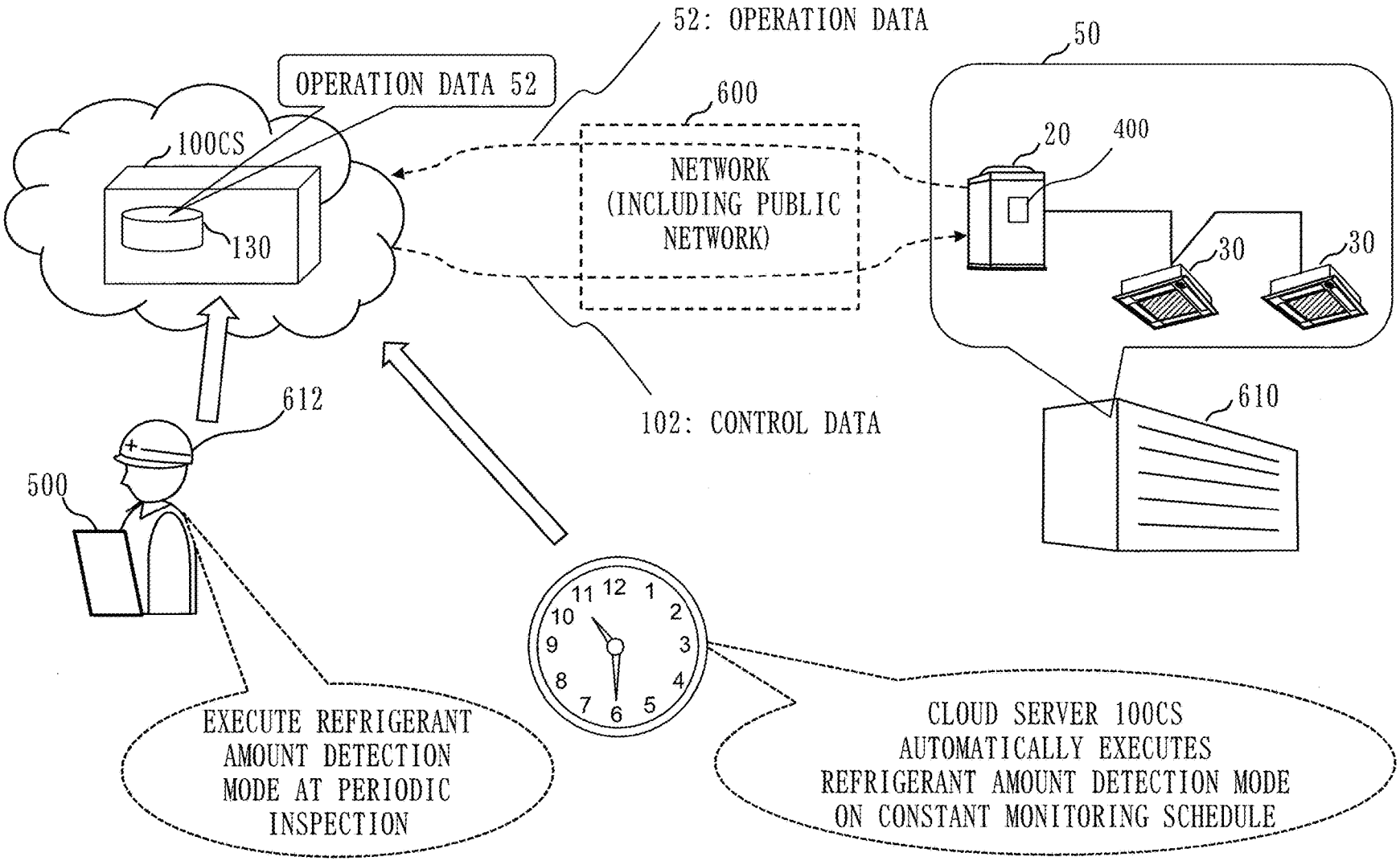
FIG. 18 is a diagram of Embodiment 2 and is a diagram illustrating an outline in which the refrigerant amount detection mode is performed during normal operation of the refrigeration cycle apparatus 50.

FIG. 18 illustrates an outline in which the refrigerant amount detection mode is performed during the normal operation of the refrigeration cycle apparatus 50.

Figure 19:
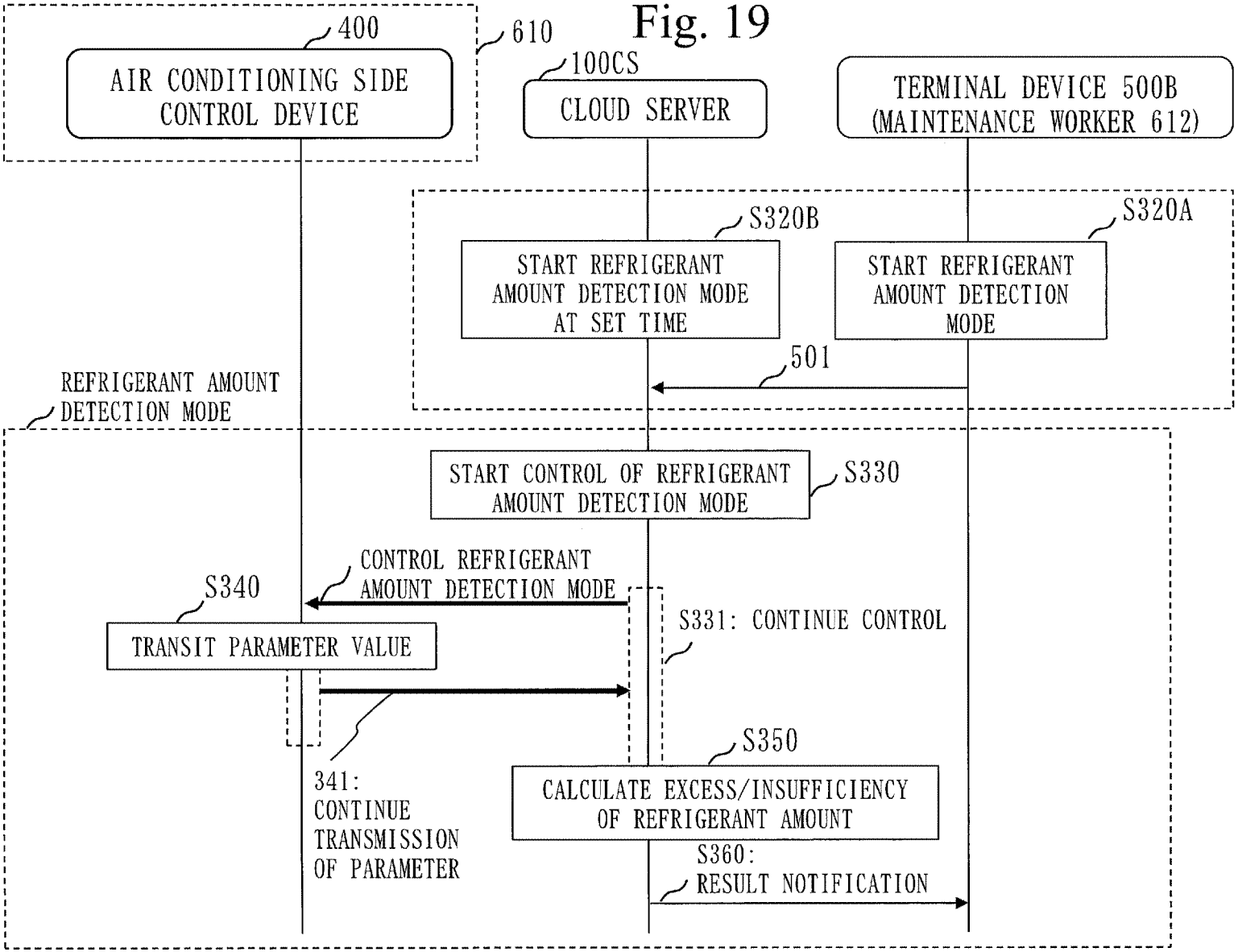
FIG. 19 is a diagram of Embodiment 2 and is a sequence diagram in which the refrigerant amount detection mode is performed during the normal operation of the refrigeration cycle apparatus 50.

FIG. 19 is a sequence diagram in which the refrigerant amount detection mode is performed during the normal operation of the refrigeration cycle apparatus 50. The performance of the refrigerant amount detection mode during the normal operation will be described with reference to FIGS. 18 and 19. In FIG. 19, steps S330 to S360 in the refrigerant amount detection mode are the same as steps S230 to S260 of FIG. 17 except that the terminal device 500A is not present. Therefore, description of steps S330 to S360 is omitted.

<Steps S320A and S320B>

As with step 220, the refrigerant amount detection mode is started with the start command 501, in step S320A. In the case of step S320A, the maintenance worker 612 transmits the start command 501 using the terminal device 500B during periodic inspection. Step S320B is automatically executed on a daily constant monitoring schedule. Specifically, a start time of the refrigerant amount detection mode is set in the control unit 112 of the cloud server 100CS. The control unit 112 also has a timer function.

Figure 20:
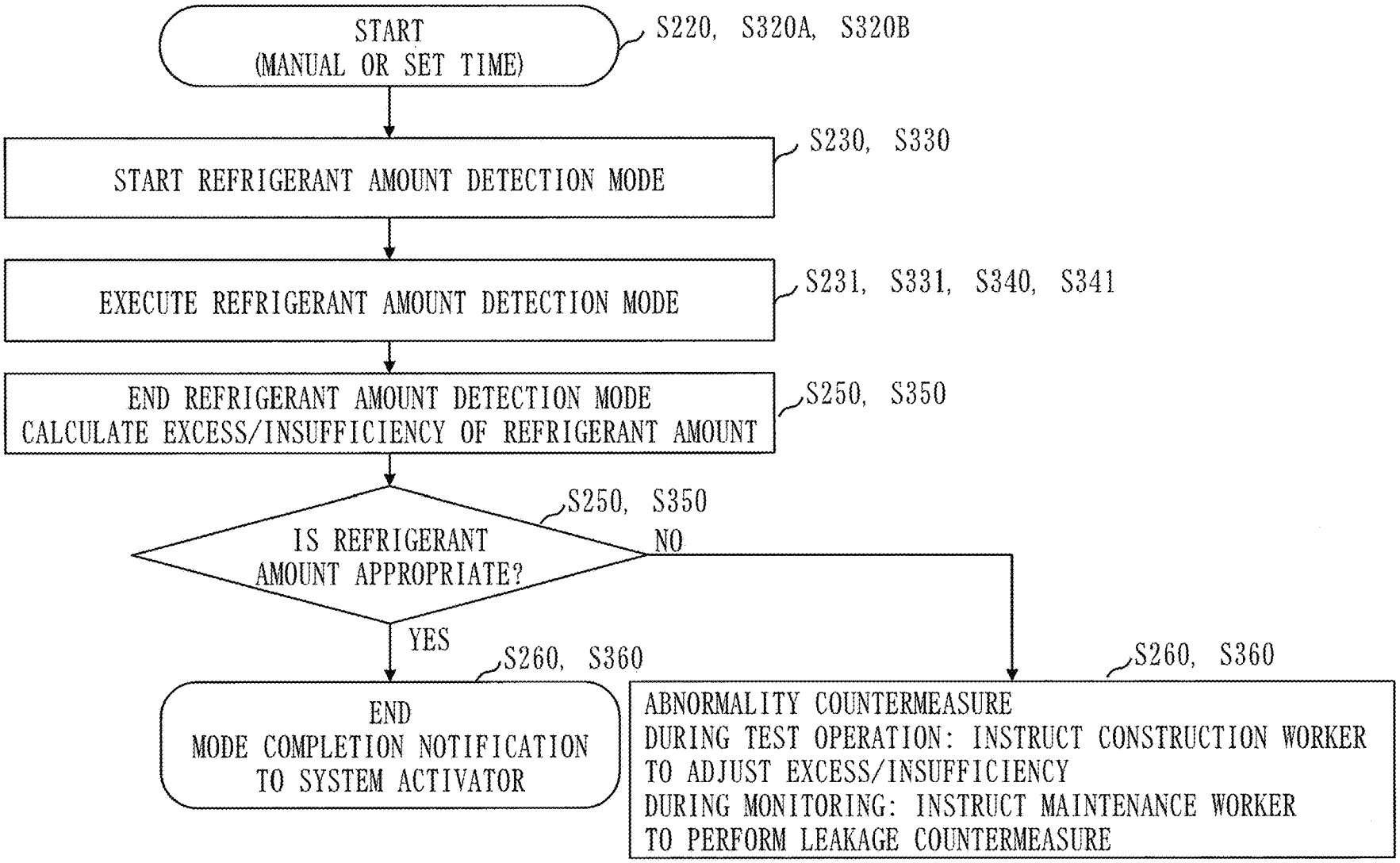
FIG. 20 is a diagram of Embodiment 2 and is a flowchart illustrating processes of FIGS. 17 and 19.

FIG. 20 is a flowchart illustrating the processes of FIGS. 17 and 19. As illustrated in FIG. 20, when the refrigerant amount is not appropriate (NO in steps S250 and S350), abnormally countermeasure is performed. Specifically, the output unit 115 of the cloud server 100CS notifies the construction worker 611 of the abnormality during the test operation. The output unit 115 notifies the maintenance worker 612 of the abnormality during the normal operation. The output unit 115 instructs the construction worker 611 to adjust the excess or insufficiency of the refrigerant amount, as an abnormality notification. The output unit 115 instructs the maintenance worker 612 to perform a leakage countermeasure, as the abnormality notification. When the refrigerant amount is appropriate (YES in steps S250 and S350), the output unit 115 transmits the mode completion notification 101 to a system activator. The system activator is, for example, the maintenance worker 612.

Embodiment 3

Embodiment 3 is a modification of Embodiment 2. In Embodiment 2, the refrigerant detection apparatus 100 is implemented as the cloud server 100CS. In Embodiment 3, the refrigerant detection apparatus 100 is disposed in the outdoor unit 20. In this case, the refrigerant detection apparatus 100 may be implemented as the air conditioning side control device 400, or the refrigerant detection apparatus 100 may be implemented as a single body which is a device different from the air conditioning side control device 400.

Figure 21:
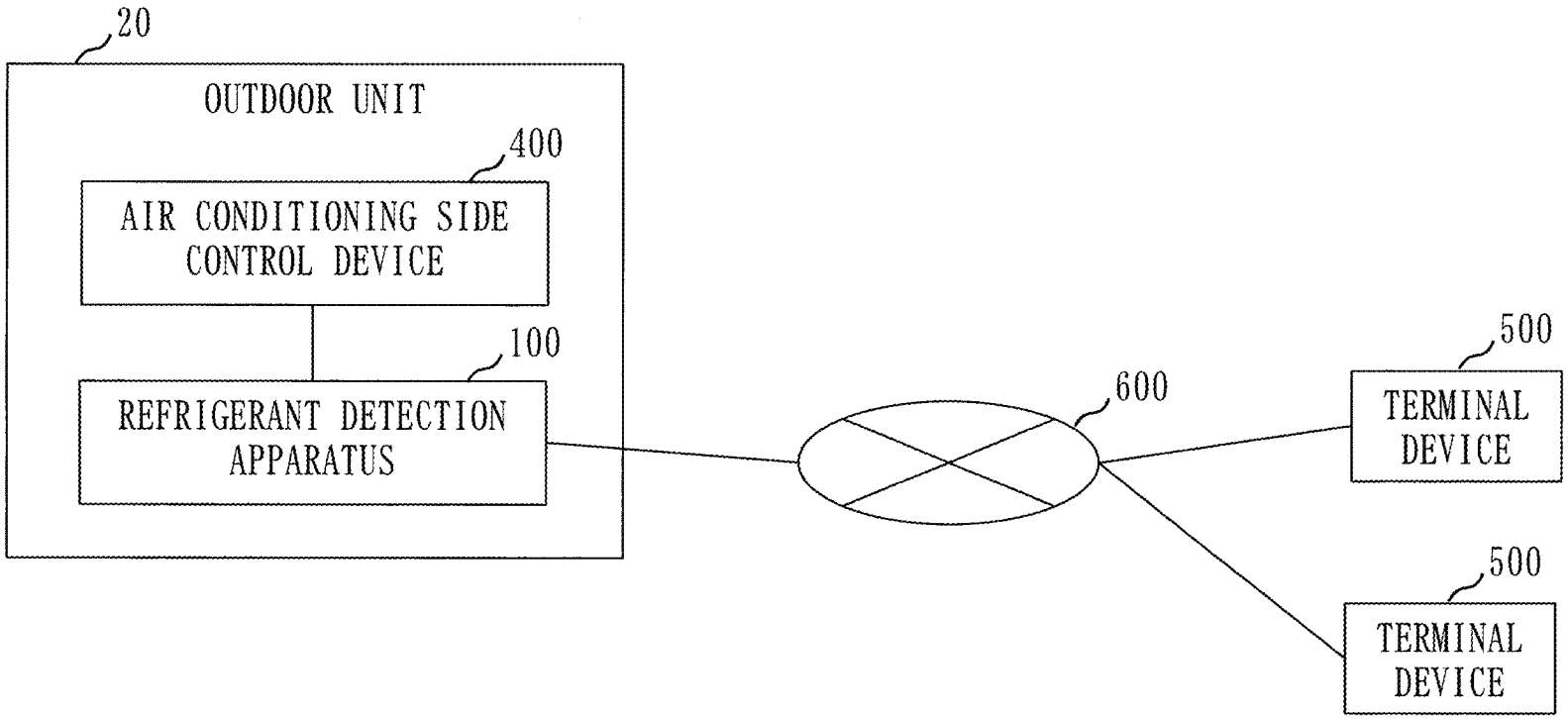
FIG. 21 is a diagram of Embodiment 3 and is a diagram illustrating a state in which the refrigerant detection apparatus 100 is implemented as a device different from the air conditioning side control device 400 and is disposed in the outdoor unit 20.

FIG. 21 illustrates a state in which the refrigerant detection apparatus 100 is implemented as the device different from the air conditioning side control device 400 and is disposed in the outdoor unit 20. In the case of the refrigerant detection apparatus 100 of Embodiment 3, the air conditioning side control device 400 and the terminal device 500 communicate with the refrigerant detection apparatus 100 disposed in the outdoor unit 20. Therefore, there is an effect that communication between the construction worker 611 and the air conditioning side control device 400 and communication between the construction worker 611 and the refrigerant detection apparatus 100 is short distance communication. Further, when the refrigerant detection apparatus 100 and the air conditioning side control device 400 are implemented in one device, there is an effect that the refrigerant detection apparatus 100 can directly perform control to each of the actuators of the refrigeration cycle apparatus 50 without passing through the air conditioning side control unit 413 of the air conditioning side control device 400. Further, when the refrigerant detection apparatus 100 and the air conditioning side control device 400 are implemented in the one device, there is an effect that as the number of devices decreases, effort to manage the devices is reduced.

Embodiments 1 to 3 have been described above. Among a plurality of technical elements included in Embodiments 1 to 3, two or more elements may be performed in combination. Alternatively, one of the plurality of technical elements included in Embodiments 1 to 3 may be partially performed.

The invention claimed is:

1. A refrigerant amount determination system comprising:

a server device;

a terminal device that communicates with the server device; and a refrigeration cycle side control device disposed in a refrigeration cycle apparatus including a compressor, a condenser, an expansion valve, and an evaporator, and having a refrigerant circuit in which a refrigerant circulates, wherein the server device comprises first processing circuitry, the terminal device comprises second processing circuitry, the second processing circuitry of the terminal device transmits to the server device, a request signal that requests detection of a refrigerant amount present in the refrigerant circuit, the first processing circuitry of the server device, when receiving the request signal, performs to the refrigerant circuit via the refrigeration cycle side control device, control of a refrigerant amount detection mode which is an operation mode of the refrigeration cycle apparatus for detecting the refrigerant amount present in the refrigerant circuit, receives from the refrigeration cycle side control device, detection values of a plurality of sensors disposed in the refrigerant circuit, as a result of the control of the refrigerant amount detection mode, calculates the refrigerant amount present in the refrigerant circuit, using the received detection values of the plurality of sensors, determines whether the refrigerant amount present in the refrigerant circuit is excessive or insufficient, using the calculated refrigerant amount and a standard refrigerant amount held as a standard, and transmits to the terminal device, a determination result of the excess or insufficiency; and the first processing circuitry of the server device determines whether or not a subcooling degree of the refrigeration cycle apparatus is at zero kelvin, using the plurality of received detection values, calculates a gas phase area ratio which is a gas phase volume rate of a total volume of the condenser when the subcooling degree is determined to be at zero kelvin, using a first temperature difference which is a difference between an outdoor temperature and a condensation temperature of the refrigerant, a second temperature difference which is a difference between a refrigerant discharge temperature of the compressor and the condensation temperature, an enthalpy difference of the refrigerant between an inlet of the condenser and an outlet of the condenser, and a specific heat at constant pressure gas of the refrigerant, compares the calculated gas phase area ratio with a standard value set as a standard for the gas phase area ratio, and calculates the refrigerant amount in the refrigeration cycle apparatus, based on a comparison result.

2. The refrigerant amount determination system according to claim 1, wherein the first processing circuitry of the server device decides a correction coefficient that corrects the first temperature difference, based on a circulation amount of the refrigerant in the refrigerant circuit decided from a specification of the compressor and an operational state of the compressor, and based on a refrigerant standard circulation amount decided as a specification of the refrigerant circuit, and corrects the first temperature difference with the decided correction coefficient.

3. The refrigerant amount determination system according to claim 1, wherein the first processing circuitry of the server device calculates the enthalpy difference of the refrigerant when the subcooling degree is at zero kelvin, based on an opening of the expansion valve, suction pressure of the compressor, discharge pressure of the compressor, and the circulation amount of the refrigerant.

4. The refrigerant amount determination system according to claim 1, wherein the first processing circuitry of the server device calculates the subcooling degree of the refrigeration cycle apparatus, determines whether or not the calculated subcooling degree is greater than zero kelvin, calculates a liquid phase area ratio which is a liquid phase volume rate of a total volume of the condenser when the subcooling degree is determined to be greater than zero kelvin, using the calculated subcooling degree, the first temperature difference, the enthalpy difference of the refrigerant, a specific heat at constant pressure liquid of the refrigerant, and the correction coefficient, compares the calculated liquid phase area ratio with a standard value set as a standard for the liquid phase area rate, and calculates the refrigerant amount in the refrigeration cycle apparatus, based on a comparison result.

5. The refrigerant amount determination system according to claim 1, wherein the refrigerant circuit includes a heat interchanger disposed between the condenser and the expansion valve, and a branch path that branches from a path between the heat interchanger and the expansion valve, passes through a second expansion valve which is different from a first expansion valve which is the expansion valve, passes through the heat interchanger, and connects to a path that connects the evaporator and the compressor, and the first processing circuitry of the server device calculates the enthalpy difference of the refrigerant when the subcooling degree is at zero kelvin, based on an opening of the first expansion value, an opening of the second expansion valve, suction pressure of the compressor, discharge pressure of the compressor, a circulation amount of the refrigerant, and a temperature of a refrigerant that has flowed out of the heat interchanger in the branch path.

6. A refrigerant amount determination system comprising:

a refrigeration cycle side control device disposed in a refrigeration cycle apparatus including a compressor, a condenser, an expansion valve, and an evaporator, and having a refrigerant circuit in which a refrigerant circulates;

a refrigerant detection apparatus that is disposed in the refrigeration cycle apparatus and detects a refrigerant amount present in the refrigerant circuit; and a terminal device that communicates with the refrigerant detection apparatus, wherein, the refrigerant detection apparatus comprises first processing circuitry, the terminal device comprises second processing circuitry, the second processing circuitry of the terminal device transmits to the refrigerant detection apparatus, a request signal that requests detection of the refrigerant amount present in the refrigerant circuit, the first processing circuitry of the refrigerant detection apparatus, when receiving the request signal, performs to the refrigerant circuit via the refrigeration cycle side control device, control of a refrigerant amount detection mode which is an operation mode of the refrigeration cycle apparatus for detecting the refrigerant amount present in the refrigerant circuit, receives from the refrigeration cycle side control device, detection values of a plurality of sensors disposed in the refrigerant circuit, as a result of the control of the refrigerant amount detection mode, calculates the refrigerant amount present in the refrigerant circuit, using the received detection values of the plurality of sensors, determines whether the refrigerant amount present in the refrigerant circuit is excessive or insufficient, using the calculated refrigerant amount and a standard refrigerant amount held as a standard, and transmits to the terminal device, a determination result of the excess or insufficiency, and the first processing circuitry of the refrigerant detection apparatus determines whether or not a subcooling degree of the refrigeration cycle apparatus is at zero kelvin, using the plurality of received detection values, calculates a gas phase area ratio which is a gas phase volume rate of a total volume of the condenser when the subcooling degree is determined to be at zero kelvin, using a first temperature difference which is a difference between an outdoor temperature and a condensation temperature of the refrigerant, a second temperature difference which is a difference between a refrigerant discharge temperature of the compressor and the condensation temperature, a enthalpy difference of the refrigerant between an inlet of the condenser and an outlet of the condenser, and a specific heat at constant pressure gas of the refrigerant, compares the calculated gas phase area ratio with a standard value set as a standard for the gas phase area ratio, and calculates the refrigerant amount in the refrigeration cycle apparatus, based on a comparison result.

* * * * *